US008721573B2

(12) United States Patent
Hoffmann

(10) Patent No.: US 8,721,573 B2
(45) Date of Patent: May 13, 2014

(54) AUTOMATICALLY ADJUSTING CONTACT NODE FOR MULTIPLE RIB SPACE ENGAGEMENT

(75) Inventor: Andrew Kenneth Hoffmann, Burnaby (CA)

(73) Assignee: Simon Fraser University, Burnaby (CA)

( * ) Notice: Subject to any disclaimer, the term of this patent is extended or adjusted under 35 U.S.C. 154(b) by 1295 days.

(21) Appl. No.: 12/378,321

(22) Filed: Feb. 17, 2009

(65) Prior Publication Data

US 2009/0270773 A1 Oct. 29, 2009

Related U.S. Application Data

(60) Continuation-in-part of application No. 12/154,508, filed on May 23, 2008, now Pat. No. 8,079,968, which is a division of application No. 10/902,122, filed on Jul. 30, 2004, now Pat. No. 7,517,328.

(51) Int. Cl.
*A61H 1/00* (2006.01)

(52) U.S. Cl.
USPC ..... 601/46; 601/49; 601/53; 601/84; 601/108

(58) Field of Classification Search
USPC ..... 601/84, 108, 110–111, 129–136, 46, 601/49, 53
See application file for complete search history.

(56) References Cited

U.S. PATENT DOCUMENTS

| | | | |
|---|---|---|---|
| 827,133 | A | 7/1906 | Weston |
| 1,498,680 | A | 6/1924 | Clement et al. |
| 2,181,282 | A | 11/1939 | Oster |
| 2,821,191 | A | 1/1958 | Pai |
| 3,085,568 | A | 4/1963 | Whitesell |
| 3,352,303 | A | 11/1967 | Delaney |

(Continued)

FOREIGN PATENT DOCUMENTS

| | | |
|---|---|---|
| BG | 49287 | 10/1991 |
| EP | 429 109 | 5/1991 |

(Continued)

OTHER PUBLICATIONS

Birnbaum, et al., "Ultrasound Has Synergistic Effects in Vitro with Tirofiban and Heparin for Thrombus Dissolution", *Thrombosis Research,* 96, (1999), pp. 451-458.

(Continued)

*Primary Examiner* — Michael A. Brown
(74) *Attorney, Agent, or Firm* — Laurence C. Bonar; Graeme A. Herring

(57) ABSTRACT

A vibratory attachment interface enabling transmission of oscillations generated by an oscillation source upon an external human body surface. The interface comprises a first contact node and a second contact node slideably mounted alongside the first contact node, wherein the contact nodes are each sized and shaped to enable seating within a human rib-space, and whereby upon forced engagement of the first contact node within a first rib-space, the second contact node automatically slides and conforms to the contour of a second differing rib-space thereby optimally nestling within the second rib-space. The attachment interface is for use in contoured application to preferably the anatomic left sternal border, third and fourth intercostal space, such as to enable and ensure an optimized vibratory transmission pathway from the chest wall to the base of the heart and coronary arteries thereupon.

31 Claims, 5 Drawing Sheets

(56) References Cited

U.S. PATENT DOCUMENTS

| | | | |
|---|---|---|---|
| 3,499,436 | A | 3/1970 | Balamuth |
| 3,499,438 | A | 3/1970 | Balamuth |
| 3,664,331 | A | 5/1972 | Filipovici |
| 3,735,755 | A | 5/1973 | Eggleton et al. |
| 3,779,249 | A | 12/1973 | Semler |
| 3,853,121 | A | 12/1974 | Mizrachy et al. |
| 4,079,733 | A | 3/1978 | Denton et al. |
| 4,098,266 | A | 7/1978 | Muchisky et al. |
| 4,216,766 | A | 8/1980 | Duykers et al. |
| 4,232,661 | A | 11/1980 | Christensen |
| 4,269,175 | A | 5/1981 | Dillon |
| RE31,603 | E | 6/1984 | Christensen |
| 4,484,569 | A | 11/1984 | Driller et al. |
| 4,507,816 | A | 4/1985 | Smith et al. |
| 4,538,596 | A | 9/1985 | Colasante |
| 4,651,716 | A | 3/1987 | Forester et al. |
| 4,779,615 | A | 10/1988 | Frazier et al. |
| 4,785,797 | A | 11/1988 | Cuervo |
| 4,791,915 | A | 12/1988 | Barsotti et al. |
| 4,838,263 | A | 6/1989 | Warwick et al. |
| 4,932,414 | A | 6/1990 | Coleman et al. |
| 4,955,365 | A | 9/1990 | Fry et al. |
| 4,966,131 | A | 10/1990 | Houghton et al. |
| 5,005,579 | A | 4/1991 | Wurster et al. |
| 5,040,537 | A | 8/1991 | Katakura |
| 5,065,741 | A | 11/1991 | Uchiyama et al. |
| 5,101,810 | A | 4/1992 | Skille et al. |
| 5,107,837 | A | 4/1992 | Ophir et al. |
| 5,132,942 | A | 7/1992 | Cassone |
| 5,143,070 | A | 9/1992 | Ophir et al. |
| 5,143,073 | A | 9/1992 | Dory |
| 5,150,712 | A | 9/1992 | Dory |
| 5,159,838 | A | 11/1992 | Lynnworth |
| 5,172,692 | A | 12/1992 | Kulow et al. |
| 5,178,147 | A | 1/1993 | Ophir et al. |
| 5,190,766 | A | 3/1993 | Ishihara |
| 5,197,946 | A | 3/1993 | Tachibana |
| 5,207,214 | A | 5/1993 | Romano |
| 5,230,334 | A | 7/1993 | Klopotek et al. |
| 5,243,997 | A | 9/1993 | Uflacker et al. |
| 5,247,937 | A | 9/1993 | Ophir et al. |
| 5,267,223 | A | 11/1993 | Flanagan et al. |
| 5,291,894 | A | 3/1994 | Nagy |
| 5,293,870 | A | 3/1994 | Ophir et al. |
| 5,303,433 | A | 4/1994 | Jang |
| 5,307,816 | A | 5/1994 | Hashimoto et al. |
| 5,391,140 | A | 2/1995 | Schaetzle et al. |
| 5,413,550 | A | 5/1995 | Castel |
| 5,423,862 | A | 6/1995 | Clarke et al. |
| 5,442,710 | A | 8/1995 | Komatsu |
| 5,453,081 | A | 9/1995 | Hansen |
| 5,454,373 | A | 10/1995 | Koger et al. |
| 5,474,070 | A | 12/1995 | Ophir et al. |
| 5,509,896 | A | 4/1996 | Carter |
| 5,520,612 | A | 5/1996 | Winder et al. |
| 5,520,614 | A | 5/1996 | McNamara et al. |
| 5,523,058 | A | 6/1996 | Umemura et al. |
| 5,524,620 | A | 6/1996 | Rosenschein |
| 5,549,119 | A | 8/1996 | Solar |
| 5,555,891 | A | 9/1996 | Eisenfeld |
| 5,556,372 | A | 9/1996 | Talish et al. |
| 5,558,092 | A | 9/1996 | Unger et al. |
| 5,569,170 | A | 10/1996 | Hansen |
| 5,586,346 | A | 12/1996 | Stacy et al. |
| 5,606,754 | A | 3/1997 | Hand et al. |
| 5,613,940 | A | 3/1997 | Romano |
| 5,626,554 | A | 5/1997 | Ryaby et al. |
| 5,674,262 | A | 10/1997 | Tumey |
| 5,676,637 | A | 10/1997 | Lee |
| 5,695,460 | A | 12/1997 | Siegel et al. |
| 5,698,531 | A | 12/1997 | Nabel et al. |
| 5,713,848 | A | 2/1998 | Dubrul et al. |
| 5,720,304 | A | 2/1998 | Omura |
| 5,725,482 | A | 3/1998 | Bishop |
| 5,728,123 | A | 3/1998 | Lemelson et al. |
| 5,762,616 | A | 6/1998 | Talish |
| 5,830,177 | A | 11/1998 | Li et al. |
| 5,861,015 | A | 1/1999 | Benja-Athon |
| 5,873,828 | A | 2/1999 | Fujio et al. |
| 5,879,314 | A | 3/1999 | Peterson et al. |
| 5,913,834 | A | 6/1999 | Francais |
| 5,919,139 | A | 7/1999 | Lin |
| 5,936,163 | A | 8/1999 | Greathouse |
| 5,951,501 | A | 9/1999 | Griner |
| 5,973,999 | A | 10/1999 | Naff et al. |
| 5,983,429 | A | 11/1999 | Stacy et al. |
| 6,027,444 | A | 2/2000 | Franck |
| 6,036,662 | A | 3/2000 | Van Brunt et al. |
| 6,068,596 | A | 5/2000 | Weth et al. |
| 6,082,365 | A | 7/2000 | Yenin |
| 6,093,164 | A | 7/2000 | Davis et al. |
| 6,095,979 | A | 8/2000 | Ohtomo |
| 6,110,098 | A | 8/2000 | Renirie et al. |
| 6,126,619 | A | 10/2000 | Peterson et al. |
| 6,146,342 | A | 11/2000 | Glen et al. |
| 6,155,976 | A | 12/2000 | Sackner et al. |
| 6,193,677 | B1 | 2/2001 | Cady |
| 6,200,259 | B1 | 3/2001 | March |
| 6,254,573 | B1 | 7/2001 | Halm et al. |
| 6,261,537 | B1 | 7/2001 | Klaveness et al. |
| 6,270,459 | B1 | 8/2001 | Ophir et al. |
| 6,273,864 | B1 | 8/2001 | Duarte et al. |
| 6,277,085 | B1 | 8/2001 | Flynn |
| 6,283,935 | B1 | 9/2001 | Laufer et al. |
| 6,287,271 | B1 | 9/2001 | Dubrul et al. |
| 6,296,617 | B1 | 10/2001 | Peeler et al. |
| 6,330,475 | B1 | 12/2001 | Renirie |
| 6,332,872 | B1 | 12/2001 | Young |
| 6,398,772 | B1 | 6/2002 | Bond et al. |
| 6,408,205 | B1 | 6/2002 | Renirie et al. |
| 6,424,864 | B1 | 7/2002 | Matsuura |
| 6,428,477 | B1 | 8/2002 | Mason |
| 6,432,070 | B1 | 8/2002 | Talish et al. |
| 6,432,072 | B1 | 8/2002 | Harris et al. |
| 6,434,539 | B1 | 8/2002 | Woodsum et al. |
| 6,471,663 | B1 | 10/2002 | Van Brunt et al. |
| 6,500,134 | B1 | 12/2002 | Cassone |
| 6,511,429 | B1 | 1/2003 | Fatemi et al. |
| 6,537,236 | B2 | 3/2003 | Tucek et al. |
| 6,579,251 | B1 | 6/2003 | Randoll |
| 6,635,017 | B1 | 10/2003 | Moehring et al. |
| 6,682,496 | B1 | 1/2004 | Pivaroff |
| 6,687,625 | B2 | 2/2004 | Ophir et al. |
| 6,716,184 | B2 | 4/2004 | Vaezy et al. |
| 6,719,694 | B2 | 4/2004 | Weng et al. |
| 6,733,450 | B1 | 5/2004 | Alexandrov et al. |
| 6,936,025 | B1 | 8/2005 | Evans et al. |
| 7,090,300 | B2 | 8/2006 | Fujita |
| 7,128,722 | B2 * | 10/2006 | Lev et al. ..... 601/108 |
| 7,229,423 | B2 | 6/2007 | Horzewski |
| 7,232,417 | B2 | 6/2007 | Plante |
| 7,789,841 | B2 | 9/2010 | Huckle |
| 2002/0016560 | A1 | 2/2002 | Hansen |
| 2002/0049395 | A1 | 4/2002 | Thompson et al. |
| 2002/0055693 | A1 | 5/2002 | Thompson et al. |
| 2002/0072690 | A1 | 6/2002 | Thompson et al. |
| 2002/0072691 | A1 | 6/2002 | Thompson et al. |
| 2002/0082529 | A1 | 6/2002 | Suorsa et al. |
| 2002/0091339 | A1 | 7/2002 | Horzewski |
| 2002/0103454 | A1 | 8/2002 | Sackner et al. |
| 2002/0161315 | A1 * | 10/2002 | Harris et al. ..... 601/84 |
| 2002/0193833 | A1 | 12/2002 | Dimmer et al. |
| 2003/0009119 | A1 | 1/2003 | Kamm |
| 2003/0028111 | A1 | 2/2003 | Vaezy et al. |
| 2003/0028134 | A1 * | 2/2003 | Lev et al. ..... 601/110 |
| 2003/0083599 | A1 | 5/2003 | Kitov |
| 2003/0135085 | A1 | 7/2003 | Bassuk et al. |
| 2003/0163067 | A1 | 8/2003 | Lidgren |
| 2003/0181812 | A1 | 9/2003 | Rabiner et al. |
| 2003/0204141 | A1 | 10/2003 | Nock et al. |
| 2003/0236476 | A1 | 12/2003 | Inman et al. |
| 2004/0006288 | A1 | 1/2004 | Spector et al. |
| 2004/0122354 | A1 | 6/2004 | Semba et al. |
| 2004/0133066 | A1 | 7/2004 | Mann et al. |

(56) References Cited

U.S. PATENT DOCUMENTS

| | | | |
|---|---|---|---|
| 2004/0153009 | A1 | 8/2004 | Horzewski et al. |
| 2004/0173220 | A1 | 9/2004 | Harry et al. |
| 2005/0004460 | A1 | 1/2005 | Taylor et al. |
| 2005/0054958 | A1 | 3/2005 | Hoffmann |
| 2005/0096669 | A1 | 5/2005 | Rabine et al. |
| 2005/0148807 | A1 | 7/2005 | Salkinder |
| 2005/0203398 | A1 | 9/2005 | Sandrin et al. |
| 2006/0282026 | A1 | 12/2006 | Glen et al. |
| 2007/0123809 | A1 | 5/2007 | Weiss et al. |
| 2007/0173751 | A1 | 7/2007 | Ohashi |
| 2007/0225618 | A1 | 9/2007 | Ward et al. |
| 2008/0221489 | A1 | 9/2008 | Madsen et al. |
| 2008/0275371 | A1 | 11/2008 | Hoffmann |

FOREIGN PATENT DOCUMENTS

| | | | |
|---|---|---|---|
| FR | 608893 | | 12/1925 |
| FR | 284 3290 | | 2/2004 |
| GB | 2167961 | | 6/1986 |
| JP | 4156823 | | 5/1992 |
| JP | 8089549 | | 4/1996 |
| JP | 11192276 | | 7/1999 |
| RU | 2187295 | C2 | 2/2002 |
| WO | WO 85/03634 | | 8/1985 |
| WO | WO 87/05497 | | 9/1987 |
| WO | WO 9428873 | | 12/1994 |
| WO | WO 95/01770 | | 1/1995 |
| WO | WO 96/39955 | | 12/1996 |
| WO | WO 97/40806 | | 11/1997 |
| WO | WO 00/00155 | | 1/2000 |
| WO | WO 00/67693 | | 11/2000 |
| WO | WO 02/04071 | A1 | 2/2001 |
| WO | WO 02/07582 | | 1/2002 |
| WO | WO 02/43645 | | 6/2002 |
| WO | WO 02/054018 | | 7/2002 |

OTHER PUBLICATIONS

Birnbaum, et al., "Noninvasive in Vivo Clot Dissolution Without a Thrombolytic Drug—Recanalization of Thrombosed Iliofemoral Arteries by Transcutaneous Ultrasound Combined with Intravenous Infusion of Microbubbles", *Circulation* 1998, 97, pp. 130-134.

Birnbaum, et al., "Noninvasive Transthoracic Low Frequency Ultrasound Augments Thrombolysis in a Canine Model of Acute Myocardial Infarction—Evaluation of the Extent of ST-Segment Resolution", *Journal of Thrombosis and Thrombolysis* 11(3), pp. 229-234, 2001.

Blinc, et al., "Characterization of Ultrasound-Potentiated Fibrinolysis In Vitro", *Blood,* vol. 81, No. 10 (May 15,1993),pp. 2636-2643.

Braaten, et al., "Ultrasound Reversibly Disaggregates Fibrin Fibers", *Thromb Haemost,* 1997, 78, pp. 1063-1068.

Christen, et al., "Effects of Intermittent Pneumatic Compression on Venous Haemodynamics and Fibrinolytic Activity", *Blood Coagulation and Fibrinolysis,* vol. 8, 1997,pp. 185-190.

Comerota, et al., "The Fibrinolytic Effects of intermittent Pneumatic Compression", *Annals of Surgery,* vol. 228, No. 3, pp. 306-314, 1997.

Dalen, et al., "Coronary Spasm, Coronary Thrombosis, and Myocardial Infarction: A Hypothesis Concerning the Pathophysiology of Acute Myocardial Infarction", *American Heart Journal,* vol. 104, No. 5, Part 1, Nov. 1982, pp. 1119-1124.

Farber, et al., "Conduction of Cardiovascular Sound Along Arteries", *Circulation Research,* vol. XII, Mar. 1963, pp. 308-316.

Francis, et al., "Ultrasound Accelerates Transport of Recombinant Tissue Plasminogen Activator Into Clots", *Ultrasound in Med. & Biol.,* vol. 21, No. 3, pp. 419-424, 1995.

Francis, "Ultrasound-Enhanced Thrombolysis", *Echocardiography: A Jrnl. Of CV Ultrasound & Allied Tech.,* vol. 18, No. 3, 2001, pp. 239-246.

Griesinger, et al., "Vibration Induced Current Fields and Cavitational Effect", *Zahnarztlkhe Praxis,* 1989, vol. 40, No. 6,pp. 213-217.

Hackett, et al., "Intermittent Coronary Occlusion in Acute Myocardial Infarction—Value of Combined Thrombolytic and Vasodilator Therapy", *The New England Journal of Medicine,* vol. 317, No. 17, pp. 1055-1059, 1987.

Honda, et al, "Mathematical Model of the Effects of Mechanical Vibration on Crossbridge Kinetics in Cardiac Muscle", *Jpn Circ J.,* 1994, 58:pp. 416-425.

Hudlicka, et al., "The Effect of Vibration on Blood Flow in Skeletal Muscle in the Rabbit", *Clinical Science and Molecular Medicine,* (1978), 55, pp. 471-476.

Jackson, et al., "Antithrombotic Therapy in Peripheral Arterial Occlusive Disease", *American College of Chest Physicians,* 2001, 119: pp. 283S-299S, http://www.chestjournal.org/cgi/content/full/119/1_suppl/283S.

Kasirajan, et al., "Management of Acute Lower Extremity Ischemia: Treatment Strategies and Outcome", *Current interventional Cardiology Reports,* 2000, 2, pp. 119-129.

Koiwa, et al., "Measurement of Instantaneous Viscoelastic Properties by Impedance-Frequency Curve of the Ventricle", *Am. J. Physiol.,* 250, (Heart Circ. Physiol. 19), pp. H672-H684, 1986.

Koiwa, et al., "The Improvement of Systolic Function of Depressed Left Ventricle by External Vibration at Diastole", *Tohoku J. Exp. Med.,* 1989, 159, pp. 169-170.

Koiwa, et al., "Diastolic Vibration from the Precordium Increases Coronary Blood Flow in Humans", *J. Cardiovasc Diagn Procedures,* 1994, 12, p. 110, Abstract (FRI-POS 05).

Koiwa, et al., "The Effect of Diastolic Vibration on the Coronary Flow Rate in the Canine Heart With Ischemia", *J. Cardiovasc Diagn Procedures,* 1994, 12, p. 110, Abstract (FRI-POS 07).

Kovak, et al., "Thrombolysis Plus Aortic Counterpulsation: Improved Survival in Patients Who Present to Community Hospitals with Cardiogenic Shock", *J. Am. Coll. Cardiol.,* vol. 29, No. 7, Jun. 1997, pp. 1454-1458.

Lindblad, et al., "Effect of Vibration on a Canine Cutaneous Artery", *Am. J. Physiol.,* 250 (Heart Circ. Physiol. 19), pp. H519-H523, 1986.

Lincoff, et al., "Illusion of Reperfusion—Does Anyone Achieve Optimal Reperfusion During Acute Myocardial Infarction?", *Circulation,* Jun. 1993, 88, pp. 1361-1374.

Ljung, et al., "Inhibition of Vascular Smooth Muscle Contraction by Vibrations", *Abstract Acta Physiol. Scand.,* 396, Suppl., p. 95, 1973.

Ljung, et al., "Vibration-Induced inhibition of Vascular Smooth Muscle Contraction", *Blood Vessels,* 12, pp. 38-52, 1975.

Luo, et al., "Enhancement of Thrombolysis in Vivo Without Skin and Soft Tissue Damage by Transcutaneous Ultrasound", *Thrombosis Research,* 89, 1998, pp. 171-177.

Luo, et al., "Transcutaneous Ultrasound Augments Lysis of Arterial Thrombi In Vivo", *Circulation,* vol. 94, No. 4, Aug. 1996, pp. 775-778.

Luo, et al., "Effect of External Ultrasound Frequency on Thrombus Disruption in Vitro", *Journal of Thrombosis and Thrombolysis,* 1996, 3, pp. 63-66.

Margulis, et al., "Physicochemical Processes Induced by Low-frequency Acoustic Vibrations in Liquids. I. Growth and Pulsation of Gas Bubbles", *Russian Journal of Physical Chemsitry,* 56, 6, 1962, pp. 876-878.

Maseri, et al., "Coronary Vasospasm as a Possible Cause of Myocardial Infarction", *The New England Journal of Medicine,* vol. 299, No. 23, pp. 1271-1277, Dec. 1978.

Michalis, et al., "Vibrational Angioplasty and Hydrophilic Guidewires in the Treatment of Chronic Total Coronary Occlusions", *J. Endovasc. Ther.,* 2000, 7, pp. 141-148.

Morgan et al., "Arterial Flow Enhancement by Impulse Compression", *Vasc. Surg.,* 25, pp. 8-16, Jan./Feb. 1991.

Nyborg, "Ultrasonic Microstreaming and Related Phenomena", *Br. J. Cancer,* 1982, 45, Suppl. V, 156, pp. 156-160.

Oliva, et al., "Arteriographic Evidence of Coronary Arterial Spasm in Acute Myocardial Infarction", *Circulation,* vol. 56, No. 3, Sep. 1977, pp. 366-374.

Olsson, et al., "Enhancement of Thrombolysis by Ultrasound", *Ultrasound in Med. & Biol.,* vol. 20, No. 4, pp. 375-382, 1994.

Ramcharan, et al., "The Effects of Vibration Upon Blood-Viscosity and Red-Cell Mobility: A Study of In Vivo and In Vitro", *Biorheology,* pp. 341-352, 1982.

(56) References Cited

OTHER PUBLICATIONS

Riggs, et al., "Ultrasound Enhancement of Rabbit Femoral Artery Thrombolysis", *Cardiovascular Surgery,* vol. 5, No. 2, pp. 201-207, 1997.
Rosenschein, et al., "Experimental Ultrasonic Angioplasty: Disruption of Atherosclerotic Plaques and Thrombi in Vitro and Arterial Recanalization in Vivo", *J Am. Coll. Cardiol.,* vol. 15, No. 3, Mar. 1, 1990, pp. 711-717.
Rosenschein, et al., "Shock-Wave Thrombus Ablation, a New Method for Noninvasive Mechanical Thrombolysis", *The American Journal of Cardiology,* vol. 70, Nov. 15, 1992, pp. 1358-1361.
Sanborn, et al., "Impact of Thrombolysis, Intra-aortic Balloon Pump Counterpulsation, and Their Combination in Cardiogenic Shock Complicating Acute Myocardial Infarction: A Report from the SHOCK Trial Registry", *Journal of American College of Cardiology,* vol. 36, No. 3, Suppl. A., Sep. 2000, pp. 1123-1129.
Serikova, et al., "Effect of General Low-Frequency Vibration on the Functional State of the Blood", *Voenno-Meditsinskil Zhurnal,* 1977, pp. 59-62.
Siegel, et al., "Noninvasive, Transthoracic, Low-Frequency Ultrasound Augments Thrombolysis in a Canine Model of Acute Myocardial Infarction", *Circulation,* May 2, 2000, 101, pp. 2026-2029.
Siegel, et al., "Noninvasive Transcutaneous Low Frequency Ultrasound Enhances Thrombolysis in Peripheral and Coronary Arteries", *Echocardiography: A Jrnl. Of CV Ultrasound & Allied Tech.,* vol. 18, No. 3, 2001, pp. 247-257.
Silver, et al., "The Relationship Between Acute Occlusive Coronary Thrombi and Myocardial Infarction Studied in 100 Consecutive Patients", *Circulation,* 61, No. 2, 1980, pp. 219-227.
Smith, et al., "Mechanical Vibration Transmission Characteristics of the Left Ventricle: Implications with Regard to Auscultation and Phonocardiography", *J. Am. Coll. Cardiol.,* vol. 4, No. 3, Sep. 1984, pp. 517-521.
Stone, et al., "Normal Flow (TIMI-3) Before Mechanical Reperfusion Therapy is an Independent Determinant of Survival in Acute Myocardial Infarction—Analysis from the Primary Angioplasty in Myocardial Infarction Trials", *Circulation,* Aug. 7, 2001, 104, pp. 636-641.
Suchkova, et al., "Enhancement of Fibrinolysis With 40-kHz Ultrasound", *Circulation,* 1998, 98, pp. 1030-1035.
Takagi, et al., "Diastolic Vibration Improves Systolic Function in Cases of Incomplete Relaxation", *Circulation,* vol. 86, No. 6, Dec. 1992, pp. 1955-1964.
Takashima, et al., "Effects of Mechanical Force on Blood Fibrinolytic Activity ", *Thrombosis and Haemostasis,* 58, 1987, Abstract.
Tamay, et al., "Pneumatic Calf Compression, Fibrinolysis, and the Prevention of Deep Venous Thrombosis", *Surgery,* Oct. 1980, pp. 489-496.
Templeton, et al., "Influence of Acute Myocardial Depression on Left Ventricular Stiffness and Its Elastic and Viscous Components", *The Journal of Clinical Investigation,* vol. 56, Aug. 1975,pp. 278-285.
Tiffany, et al., "Bolus Thrombolytic Infusions During CPR for Patients with Refractory Arrest Rhythms: Outcome of a Case Series", *Annals of Emergency Medicine,* 31:1, Jan. 1998, pp. 124-126.
Wobser, et al., "Intragastral Disintegration of Blood Coagula by Mechanical Vibration", *Endoscopy,* 10, 1978, pp. 15-19.
[No authors listed] Working Party on Thrombolysis in the Management of Limb Ischemia, "Thrombolysis in the Management of Lower Limb Peripheral Arterial Occlusion—A Consensus Document", *J. Vasc. Interv. Radlol.,* 2003, pp. S337-S349.
Yock, et al, "Catheter-Based Ultrasound Thrombolysis—Shake, Rattle and Reperfuse", *Circulation,* 1997, 95, pp. 1360-1382.
Zalter, et al., "Acoustic Transmission Characteristics of the Thorax", *J. Appl. Physiol.,* 1963, 18, pp. 428-436.
Ng, K. et al., "Therapeutic Ultrasound: Its Application in Drug Delivery", Medicinal Research Reviews, vol. 22, No. 2, pp. 204-223, 2002.
Tachibana, K. et al., "The Use of Ultrasound for Drug Delivery", Echocardiography, vol. 18, No. 4, pp. 323-328, May 2001.
Hull, W. et al., "Heat-Enhanced Transdermal Drug Delivery: A Survey Paper, "The Journal of Applied Research, vol. 2, No. 1, Winter 2002.
Rapoport, N., International Cancer Research Portfolio Abstract,—award funding period Jan. 15, 1999-Dec. 31, 2002, Award code CA076562.
Cho, C-W, et al., "Ultrasound Induced Mild Hyperthermia as a Novel Approach to Increase Drug Uptake in Brain Microvessel Endothelial Cells", Pharm. Res. Aug. 2002, 19(8):1123-9.
Folts, D., "An In Vivo Model of Experimental Arterial Stenosis, Intimal Damage, and Periodic Thrombosis", Circ. 1991, 83 supp. IV:pp. IV-3 IV-14.
Folts, D., "Folts Cyclic Flow Animal Model", Contemporary Cardiology, Vascular Disease and Injury Preclinical Research, pp. 127-145, Humana Press Inc., Nov. 9, 2000.
Google Web Address: "Good Vibrations Personal Energiser—Vitafon—IR", Title: "Vitafon—IR for the temporary relief of pain". Google cache retrieval date, Apr. 29, 2006.
Kurtus, R: Google Address: "Hearing Pitch or Sound Frequencies—Succeed Through Using your Senses". Title: "Hearing Pitch Sound Frequencies", Mar. 7, 2001.
Google Web Address: "Frequency Hearing Ranges in Dogs and other Species", Title: "How well do dogs and other animals hear?", Google cache retrieval date Jun. 12, 2006.
Siegel R.J., "Ultrasound augmentation of thrombolysis and tissue perfusion", *Clin. Physiol. Funct. Imaging,* 2004, 24,pp. 156-163.
Coleman et al., "Therapeutic Ultrasound in the Production of Ocular Lesions", *American Journal of Ophthal.,* vol. 86, No. 2, 1978, pp. 185-192.
Coleman et al., "Application of therapeutic Ultrasound in Ophthalmology", *Progress in Medical Ultrasound,* 1981, pp. 263-270.
Blinc, et al., "Characterization of Ultrasound-Potentiated Fibrinolysis in Vitro", *Blood,* vol. 81, No. 10 (May 15, 1993), pp. 2636-2643.
Braaten, et al, "Ultrasound Reversibly Disaggregates Fibrin Fibers", *Thromb Haemost,* 1997, 78,pp. 1063-1068.
Christen, et al, "Effects of Intermittent Pneumatic Compression on Venous Haemodynamics and Fibrinolytic Activity", *Blood Coagulation and Fibrinolysis,* vol. 8, 1997. pp. 185-190.
Comerota, et al., "The Fibrinolytic Effects of Intermittent Pneumatic Compression", *Annals of Surgery,* vol. 226, No. 3, pp. 306-314,1997.
Dalen, et al., "Coronary Spasm, Coronary Thrombosis, and Myocardial Infarction: A Hypothesis Concerning the Pathophysiology of Acute Myocardial Infarction", *American Heart Journal,* vol. 104. No. 5, Part 1, Nov. 1982, pp. 1119-1124.
Griesinger, et al., "Vibration Induced Current Fields and Cavitational Effect", *Zahnarztliche Praxis,* 1989, vol. 40, No. 6, pp. 213-217.
Honda, et al, "Mathematical Model of the Effects of Mechanical Vibration on Crossbridge Kinetics in Cardiac Muscle", *Jpn Circ J.,* 1994, 58: pp. 416-425.
Hudlicka, et al., "The Effect of Vibration on Blood Flow in Skeletal Muscle in the Rabbit", *Clinical Science and Molecular Medicine,* (1978) 55, pp. 471-476.
Jackson, et al., "Antithrombotic Therapy in Peripheral Arterial Occlusive Disease", *American College of Chest Physicians,* 2001,119: pp. 283S-299S, http://www.chestjournal.org/cgi/content/full/119/1_suppl/283S.
Koiwa, et al., "The Improvement of Systolic Function of Depressed Left Ventricle by External Vibration at Diastole", *Tohoku J. Exp. Med.,* 1989,159, pp. 169-170.
Lindblad, et al., "Effect of Vibration on a Canine Cutaneous Artery", *Am. J. Physiol.,* 250 (Heart Circ. Physiol. 19); pp. H519-H528, 1986.
Ljung, et al., "Vibration-Induced Inhibition of Vascular Smooth Muscle Contraction", *Blood Vessels,* 12,pp. 38-52,1975.
Margulis, et al., "Physicochemical Processes Induced by Low-frequency Acoustic Vibrations in Liquids. I. Growth and Pulsation of Gas Bubbles", *Russian Journal of Physical Chemistry,* 56, 6, 1982,pp. 876-878.
Morgan, et al., "Arterial Flow Enhancement by Impulse Compression", *Vasc. Surg.,* 25, pp. 8-16, Jan./Feb. 1991.
Olsson, et al., "Enhancement of Thrombolysis by Ultrasound", *Ultrasound in Med. & Biol.,* vol. 20, No. 4,pp. 375-382, 1994.

(56) References Cited

OTHER PUBLICATIONS

Ramcharan, et al., "The Effects of Vibration Upon Blood-Viscosity and Red-Cell Mobility: A Study of In Vivo and In Vitro", *Biorheology,* 19, pp. 341-352, 1982.
Rosenschein, et al., "Shock-Wave Thrombus Ablation, a New Method for Noninvasive Mechanical Thrombolysis", *The America Journal of Cardiology,* vol. 70, Nov. 15, 1992, pp. 1358-1361.
Sanborn, et al., "Impact of Thrombolysis, Infra-aortic Balloon Pump Counterpulsation, and Their Combination in Cardiogenic Shock Complicating Acute Myocardial Infarction: A Report from the SHOCK Trial Registry", *Journal of American College of Cardiology,* vol. 36, No. 3, Suppl. A., Sep. 2000, pp. 1123-1129.
Siegel, et al., "Noninvasive, Transthoracic, Low-Frequency Ultrasound Augments Thrombolysis in a Canine Model for Myocardial Infarction", *Circulation,* May 2, 2000, 101, pp. 2026-2029.
Silver, et al., "The Relationship Between Acute Occlusive Coronary Thrombi and Myocardial Infarction Studied in 100 Consecutive Patients", Circulation 61, No. 2, 1980, pp. 219-227.
Takagi, et al., "Diastolic Vibration Improves Systolic Function in Cases of Incomplete Relaxation", *Circualtion,* vol. 86, No. 6, Dec. 1992, pp. 1955-1964.
Takashima, et al., "Effects of Mechanical Force on Blood Fibrinolytic Activity", *Thrombosis and Haemostasis,* 58, 1987, Abstract.
Tarnay, et al., "Pneumatic Calf Compression, Fibrinolysis, and the Prevention of Deep Venous Thrombosis", *Surgery,* Oct. 1980, pp. 489-496.
Templeton, et al., "Influence of Acute Myocardial Depression on Left Ventricular Stiffness and Its Elastic and Viscous Components", *The Journal of Clinical Investigation,* vol. 56, Aug. 1975, pp. 278-285.
[no. authors listed] Working Party on Thrombolysis in the Management of Limb Ischemia, "Thrombolysis in the Management of Lower Limb Peripheral Arterial Occlusion—A Consensus Document", *J. Vasc. Interv. Radiol.,* 2003, pp. S337-S349.
Yock, et al, "Catheter-Based Ultrasound Thrombolysis—Shake, Rattle and Reperfuse", *Circulation,* 1997, 95, pp. 1380-1362.
Matsuda, T et al, Extracorporeal Cardiac Shock Wave Therapy Markedly Ameliorates Ischemia-Induced Myocardial Dysfunction in Pigs In Vivo, Circulation 2004; 110; 3055-3061.
Gutersohn, A et al, "Shock waves upregulate vascular endothelial growth factor m-RNA in human umbilical vascular endothelial cells." Circulation 2000; 102 (suppl): 18.
Fisher, AB et al, Endothelial cellular response to altered shear stress. Am J Physiol. 2001; 281:L529-L533.
Wang, CJ et al, "Shock wave-enhanced neovascularisation at the tendon-bone junction: an experiment in dogs." J Foot Ankle Surg. 2002;41:16-22.
Gutersohn, A et. al, "Non Invasive Cardiac Angiogenesis shock wave therapy (NI-CATh) increased perfusion and exercise tolerance in endstage CAD patients." submitted WCC 2006.
Adams et al, "Periodic acceleration: effects on vasoactive, fibrinolytic, and coagulation factors." J Appl Physiol 98: 1083-1090, 2005.
Hudlicka, O et al, "Angiogenesis in skeletal and cardiac muscle." Physiol Rev 72: 369-417, 1992. pp. 377-378; 379-380; 383; 397-399; and 400-402.
Amaral S et al, "Angiotensin II and VEGF are Involved in angiogenesis induced by short-term exercise training," Am J. Phys Heart Circ 281(3):H1163-H1169, Sep. 2001.
Suhr, "Effects of Short-term Vibration and Hypoxia during High-Intensity Cycling Exercise on Circulating Levels of Angiogenic Regulators in Humans" J App. Physiol Apr. 2007.
Malek et al, "Fluid shear stress differentially modulates expression of genes encoding basic fibroblast growth factor . . . " J Clin. Invest. 92: 2013-2021, 1993.
Mitsumata et al. "Fluid shear stress stimulates platelet-derived growth factor expression in endothelial cells. " Am J. Physiol. 265 (1):H3-H8, Jul. 1993.
Sumpio "Hemodynamic forces and the biology of the endothellum: signal transduction pathways in endothellal cells subjected to physical forces, " J Vasc Surg 13(6):744-6 May 1991.
Ichioka et al "Effects of shear stress on wound-healing angiogenesis in the rabbit ear chamber." J of Surg. Res. 72:29-35, 1997.
Pipp, F et al "Elevated Fluid Shear Stress Enhances Postocclusive Collateral Artery Growth and Gene Expression In Pig Hind Limb." Art Thromb Vasc Biol 2004;24:1664.
Zou, J et al "Vibration induced hearing loss in guinea pig cochlea: expression of TNF-alpha and VEGF," Healing Research vol. 202, (1-2) Apr. 2005, pp. 13-20.
Davies, P "Turbulent fluid shear stress induces vascular endothelial cell turnover in vitro."Proc. Natl. Acad. Sci. USA vol. 83, pp. 2114-2117, Apr. 1986 Cell Biology.
Krishan, L "Effect of mechanical boundary conditions on orientation of angiogenic microvessels," Cardiovasc. Research 2008 78(2):324-332.
Lacolley, "Mechanical influence of cyclic stretch on vascular endothelial cells," Card. Vasc. Research 64 (2004) 577-579.
Von Offenberg Sweeney et al, "Cyclic strain-mediated regulation of endothelial matrix metalloproteinase-2 expression and activity." Card Vasc Res. 2004 63(4): 626-634 Abstract.
Von Offenberg Sweeney et al,"Cyclic strain mediated regulation of vascular endothellal cell migration and tube formation." Bloch Biophys Res Comm 329(2) 2005 572-582 Abstract.
Wilson, E et al, "Mechanical Strain Induces Growth of Vascular Smooth Muscle Cells via Autocrine Action of PDGF." J Cell Bio. vol. 123, 1993 pp. 741-747.
U.S. Appl. No. 60/601,651, filed Sep. 27, 2007, Ward et al.
Antic S. et al, Music as an Auditory Stimulus in Stroke Patients, Coll Antropol., vol. 32, Feb. 2008 Suppl 1: pp. 19-23.
Chiu, W et al, Prolonged Stimulation with Sound Increases Angiogenesis . . . Abstract 1361-Feb. 24, 2004 Pub online http://www.aro.org/archives/2004/2004_1361.html.
Koiwa Y, Precordial or Epicardial Input of Phase-Controlled minute vibration: effect coronary flow rate in regional ischemia, New Horiz Fail. Heart Syndrome, 1996; 117-130.
Massage chairs.co.uk—Advertisement on Internet http://www.massage-chairs.co.uk/understanding.massage.chairs.htm.

* cited by examiner

AUTOMATICALLY ADJUSTING CONTACT NODE FOR MULTIPLE RIB SPACE ENGAGEMENT

CROSS REFERENCE TO RELATED APPLICATIONS

The present application is a continuation in part of U.S. patent application Ser. No. 12/154,508 entitled, "Vibrator with a plurality of contact nodes for treatment of myocardial ischemia" filed on May 23, 2008 now U.S. Pat. No. 8,079,968, which is a divisional of U.S. patent application Ser. No. 10/902,122 entitled, "Low frequency vibration assisted blood perfusion emergency system" filed on Jul. 30, 2004 now U.S. Pat. No. 7,517,328, which claims priority to Canadian Patent Application No. 2439667 A1 entitled, "Low frequency vibration assisted blood perfusion system and apparatus" filed Sep. 4, 2003. The contents of these applications are incorporated herein by reference in their entirety.

FIELD OF THE INVENTION

This invention relates to noninvasive medical systems for imparting low frequency mechanical vibration energy to a human chest wall, for treatment of blood flow disturbances within the thoracic cavity.

BACKGROUND OF THE INVENTION

Blood flow problems within the thoracic cavity, especially when in relation to the heart, are serious medical concerns. Coronary thromboses (heart attack) in particular is ultimately the leading cause of death for men and women in the developed world, and angina pectoris (chest discomfort relating to coronary artery narrowings) afflicts about 16 to 20 million citizens in the United States alone.

Emergency treatment of Acute ST Elevation Myocardial Infarction (STEMI), the most feared and serious form of heart attack, is commonly by Primary Percutaneous Coronary Intervention (PPCI—otherwise termed angioplasty, where a balloon and typically a stent is inserted within a thrombosed coronary artery to restore flow), or if a patient cannot reach a cardiac cath-lab where PPCI is performed within 90 minutes, they may receive intravenous thrombolytic drug therapy which alternatively dissolves the coronary thrombosis.

There are always delays to treatment in execution of PPCI, and sometimes because of distal embolization, poor or no reflow following the PPCI procedure take place which leads to poor patient outcomes. Thrombolytic drug therapy while offering early revascularization (which is highly desirable, as "time is muscle") unfortunately does not have a high success rate with only about 50% of cases achieving an acceptable level of reperfusion (restoration of blood flow) within 90 minutes of administration of therapy, hence adjuncts to these technologies to promote early reperfusion are required.

Recently non-invasively delivered, Localized, Low Frequency Vibration (LLFV) administered upon the thoracic cavity in the sonic to infrasonic ranges (i.e. between 1-1000 Hz, 0.1-10 mm, preferably 20-120 Hz, 1 mm-10 mm, optimally about 50 Hz, greater than 2 mm), such as applied to rib-spaces of the anterior chest wall (or more specifically to the anatomic left and right of the sternum at the level of the fourth intercostal space), has received attention as a possible adjunct to clot dissolving drug therapy in the emergency treatment of STEMI.

Chest wall administered LLFV causes clot disruption and disadhearment of coronary thrombosis from a blocked endothelial surface of an ulcerated plaque (the most common etiology of STEMI), vasodilation of a culprit coronary artery (which is often in a state of spasm), and improves mixing of systemically delivered clot dissolving agents, through introduction of convection currents, down a zero flow thrombosed coronary circulation.

LLFV when applied exclusively in the diastolic period of the cardiac cycle (hereinafter "Diastolic LLFV"), particularly improves coronary flow. Diastolic LLFV relaxes the myocardium (and thereby decreases intra-myocardial vascular tone) and lowers the left ventricular diastolic pressures, which further promotes coronary flow from epicardium to endocardium. Diastolic LLFV is also useful to prevent "no flow" or "low flow" reperfusion which may occur following PPCI or IV thrombolysis—whereby the distal clotted fragments embolize and occlude the more distal circulatory beds within the myocardium.

Diastolic LLFV advantageously confers a positive contractile effect to the heart in treatment of heart failure or cardiogenic shock, as besides improving myocardial perfusion, also improves relaxation of the left ventricle which improves diastolic filling and thereby increases stroke volume by Starlings Law. Diastolic LLFV thereby comprises a preferred treatment for STEMI, such as to prevent or treat complications of associated heart failure or cardiogenic shock, which not uncommonly accompany STEMI, and which generally otherwise carry a poor prognosis. Diastolic LLFV can also be used more generally in an intensive care unit for any condition which requires a temporary ventricular assist, such as in cases of heart failure or cardiogenic shock as an adjunct to medical therapy or a bridge to more invasive cardiac assist measures.

In chronic out patient therapy, the delivery of chest wall LLFV also causes sheer stresses to the coronary endothelium which are know to induce the vessels to undergo angiogenesis, or more broadly growth of coronary arterial vessels. Diastolic LLFV, because of its positive effect on ventricular performance and assisting coronary blood flow, may be preferable and safer for such patients, who often have a cardiomyopathy with reduced ejection fraction concomitant with their coronary arterial disease. Chest wall LLFV thereby also offers a valid long term treatment option for angina pectoris.

LLFV applied with randomized frequency changes (hereinafter "Randomic LLFV"), which adds turbulence to a treated coronary artery, is a preferred vibratory waveform for disrupting thrombosis (such as in treatment of STEMI) and stimulating the coronary endothelium for up regulating angiogenic beneficial mediators to cause angiogenesis.

It has been ascertained by the Applicant, that to ensure optimized chest wall LLFV penetration to the heart (and coronary arteries thereupon), there is a need to, besides vibrating across the sternum at the fourth intercostal space (which advantageously matches the anatomic configuration of the left and right coronary artery), also vibrate simultaneously the anatomic left third intercostal space generally proximate the left sternal margin, as the left third intercostal space is anatomically situated in most cases directly over the base of the heart whereby the left coronary system arises.

The left fourth intercostal space comprises a particularly reliable acoustic transmission window from the chest wall to the heart as the acoustic transmission pathway is not typically interfered by from lung (which contains air and thereby does not transmit acoustic energy). The acoustic penetration pathway between the anatomic left third intercostal space proximate the sternal margin and the heart however, while most often ideally situated over the base of the heart, is often blocked by lung (up to about 50% of the time), and hence is somewhat unreliable. It is thereby advantageous to, besides vibrating across the sternum across the fourth intercostal space, also simultaneously vibrate the anatomic left third intercostal space, to ensure optimized transmission of vibration from the chest wall to the coronary arteries of the heart.

Jap. Pat. No. JP 8,089,549 ("549") to Koiwa and Honda discloses a noninvasive 50 Hz Diastolic LLFV system via a singular mechanical probe to skin coupling interface which enhances myocardial perfusion in view to treating heart failure. The '549 patent increases coronary blood flow to stable patients with known coronary artery narrowings, through a prescribed method of applying vibration specifically timed to the diastolic phase of the cardiac cycle. The disclosed single probe to skin coupling however, as eluded to above, is a sub-optimal means of vibration to chest wall transmission and penetration as only one rib-space over the heart must be chosen.

Low frequency vibrators with a pair or greater than a pair of contact nodes are well known for therapeutic massage of sore tired muscles and in chest wall applications for mobilization of pulmonary congestions, but have generally found no utility in the treatment of acute or chronic vascular obstructions in treatment of coronary artery disease or other related blood flow afflictions which may particularly occur within the thoracic cavity.

Common commercially available devices with a plurality of contact nodes which enable multiple rib-space contact such as to the anatomic left and right of the sternum (e.g. Mini Pro 2 Thumper, Thumper, Homedics Professional Percussion Massager, Sharper Image HF575 Percussion Massager, Brookestone Therepsa Percussion Massager), while potentially useful for administration of chest wall LLFV in treatment of cardiac ailments, are not ideal as the devices do not have a third contact node enabling simultaneous contact to the left third intercostal space. Furthermore, for those massagers which offer adjustable contact node spacing, the contact nodes cannot be disposed close enough relative to one another to enable simultaneous percussion to the anatomic left third and left fourth intercostal space at or near the left sternal margin of a human adult subject. Also, even if the contact nodes on these devices could be brought closer together, the adjustable spacing features for these types of devices are performed by manual controls (either electronic or mechanical) which would require pre-measuring a distance between the rib-spaces of a patient, and then attempting to manually adjust the contacts—which at best comprises an awkward, time consuming, and somewhat inaccurate step.

It would thereby be desirable from a ease of application stand point to provide a vibratory attachment interface for a vibration massager, which besides providing a pair of contact nodes which can simultaneously seat to the anatomic left and right of the sternum (such as at the fourth intercostal space), would also provide at least a third contact node which would, once forcefully applied generally over and upon the left third intercostal space, automatically gravitate to an optimized, flush, opposed seating within such left third intercostal space, without the need of an awkward, operator controlled manual measurement and application step.

In reference to FIG. 1, co-pending U.S. patent application Ser. No. 12/154,508 filed by the present applicant (of which the present application is a continuation in part) discloses a vibratory attachment interface 100 with adjustably spaced contact nodes which are advantageously enabled to simultaneously seat across a patient's sternum, and within the anatomic left third and left fourth intercostal space. The attachment interface 100 disclosed comprises manually spaced contact nodes 12 with screws 26 and support arms 22 whereby contact nodes 12 are slideably mounted upon an elongated member 24. Elongated member 24 is attachable to a vibratory post 16 of a vibration massager (massager not shown) which oscillates up and down to cause vibration. Technically, if screws 26 were left loose during engagement of the attachment interface to a chest wall surface, positioning of a first contact node 12*a* upon a first rib-space (such as the left fourth intercostal space) could foresee ably derive by engagement force and natural contour migration an automatic movement of a second contact node 12*b* to gravitate and optimally seat or nestle within a second intercostal space (such as the left third intercostal space) without need of a particular manual positioning step. However, this was not how the attachment interface 100 was intended nor designed for use, and the migration of contact nodes 12*a* and 12*b* would not necessarily function in this particular manner depending on the initial (pre-engagement) position of the second contact node relative to the first.

As can be seen from above, there is a need for an improvement to the U.S. Ser. No. 12/154,508 attachment interface 100, so that when a first anatomically leftward situated contact is seated within a fourth intercostal space, a directly opposing anatomically leftward contact would automatically gravitate to its optimal fitted (or substantially flush or opposed) position within the third intercostal space (or vise versa), without the need of pre-measuring or manual adjustments and re-configurations by an operator.

SUMMARY OF THE INVENTION

The present invention relates to an improvement to the design of the vibratory attachment interface 100 disclosed in co-pending U.S. patent application Ser. No. 12/154,508 which besides offering a pair of contact nodes enabling bridging across the sternum (such as at the fourth intercostal space), also provides an additional automatically adjusting leftward oriented contact node, whereby upon engagement of a first "stationary" leftward oriented contact node to a first leftward rib-space (such as the left fourth intercostal space), the second "automatically adjusting" anatomic leftward oriented contact node automatically migrates (without the need of a manual adjustment step by an operator), to a second immediately opposing leftward rib-space at a differing intercostal space level (such as the left third intercostal space), to establish substantially flush, opposed seating within such directly opposing rib-space.

External imparting of high amplitude sonic to infrasonic mechanical vibration to the anatomic left and right of the sternum fourth intercostal space, along with vibration to the anatomic left third intercostal space at or near the left sternal margin, ensures optimized penetration of vibration to the heart and coronary arteries thereupon, such as to yield an exemplary vibration therapy system for treatment of STEMI, angina pectoris, induction of coronary angiogenesis, and treatment of heart failure or cardiogenic shock.

A noninvasive vibrator is provided operable in conjunction with such attachment interface which thereby enables high amplitude low frequency external vibration to optimally and comfortably penetrate from the chest wall to the heart, without the requirement of a skilled imaging technique, and thereby invoking an agitative response to a culprit coronary circulation.

Agitation of the epimyocardium by vibration stimuli, and hence the coronary arteries, will improve (by way of convection currents, sheer forces and cavitation) the mixing of systemically introduced drugs down an otherwise zero flow, or low flow vascular system. Mechanically delivered LLFV further induces disruption and disadhearment of clots which leads to increased permeation of drugs into the clots, and also LLFV independently results in a localized coronary vasodilatory response to the culprit circulation which often has a degree of spasm associated.

LLFV timed predominantly to the diastolic period of the cardiac cycle (and turned off during systole) relaxes the myocardium, which thereby lowers diastolic pressures and improving left ventricular filling (which leads to an improved inotropic effect by Starlings Law), such as offer treatment of heart failure and cardiogenic shock.

LLFV also causes sheer stresses to the coronary endothelium which cause up-regulation of endothelial derived beneficial mediators which induce angiogenesis, hence chest wall LLFV can also be used for treatment of patients with angina pectoris, on an outpatient basis.

It is a general object of the present invention is to provide a system and a preferred apparatus enabling an easy to impart, non-skilled based vibration therapy, comprising the steps of in a single step placing a vibratory attachment interface non-invasively to the chest wall deemed proximate to the base of the heart, and applying low frequency vibration (between 1-1000 Hz, optimally in the range of 20-120 Hz, and most preferably, particularly for STEMI and coronary angiogenesis applications, via Randomic LLFV with variable frequency centered in the 50 Hz range, at a high force (i.e. preferably with an engagement force preferably greater than 50 newtons in women, and preferably greater than 100 newtons in men, with a stroke length of at least 1 mm, and when tolerated preferably greater than 2 mm and up to about 6 mm or even 10 mm) simultaneously across the sternum at the level of the fourth intercostal space, and to the left third intercostal space at or near the left sternal margin.

It is a particular object of the present invention to provide a vibratory attachment interface enabling transmission of oscillations generated by an oscillation source locally upon an external human chest wall surface, said attachment interface comprising a support member disposing a pair of contact nodes sized and spaced to enable simultaneous seating upon an adult anatomic left third and anatomic left fourth intercostal space generally proximate the left sternal margin, whereby following forceful engagement of said pair of contact nodes to said left third and left fourth intercostal space, at least one contact node of said pair automatically alters its position relative to the other contact node of said pair such as to enable substantially flush, opposed seating of said pair of contact nodes within said left third and left fourth intercostal space, generally proximate the sternal margin.

It is a particular object of the present invention to provide a vibratory attachment interface as above identified, wherein a first contact node of said pair is fixed in position relative to said support member, and a second contact node of said pair is slideably mounted upon said support member, such as to enable movement of said second contact node relative to said first contact node.

It is a particular object of the present invention to provide a vibratory attachment interface as above identified, wherein at least one of said contact nodes has a substantially convex contact surface.

It is a particular object of the present invention to provide a vibratory attachment interface as above identified, wherein an engagement center of a first contact node and an engagement center of a second contact node are semi-rigidly positioned in the range of 2.75 cm and 3.50 cm apart prior to engagement of said interface to a chest wall surface, whereby by application of force during engagement of said interface to a chest wall surface, the spacing between said first contact node and said second contact node can be altered.

It is a particular object of the present invention to provide a vibratory attachment interface as above identified, wherein said engagement center of said first contact node and said engagement center of said second contact node are semi-rigidly spaced in the range of 2.75 cm to 3.25 cm apart prior to engagement of said interface for women.

It is a particular object of the present invention to provide a vibratory attachment interface as above identified, wherein said engagement centre of said first contact node and said second contact node are semi-rigidly spaced in the range of 3.0 to 3.5 cm apart prior to engagement of said interface for men.

It is a particular object of the present invention to provide a vibratory attachment interface as above identified, wherein said second contact node is enabled to alter its position at least 1.0 cm relative to said first contact node following engagement of said interface to a chest wall surface.

It is a particular object of the present invention to provide a vibratory attachment interface as above identified, further comprising a third contact node spaced in relation to said first contact node to enable simultaneous seating of said third and first contact node to the anatomic left and right of a human adult sternum.

It is a particular object of the present invention to provide a vibratory attachment interface as above identified, whereby at least one of said contact nodes has a contact surface length enabling rib-space engagement in a medial to lateral position, which is at least double a contact surface width enabling rib-space engagement in a superior to inferior position.

It is a particular object of the present invention to provide a vibratory attachment interface as above identified, further comprising an oscillation source operatively attached to said attachment interface, said oscillation source administrable to generate oscillations at a frequency between 1-1000 Hz, and a stroke length of 1.0 mm-10 mm which are thereby transmitted to said attachment interface.

It is a particular object of the present invention to provide a method of using the vibratory attachment interface as identified above, comprising the steps of a) positioning said pair of contact nodes generally over the anatomic left third and left fourth intercostal space, near or upon the left sternal margin, and then b) forcefully engaging said pair of contact nodes upon said third and fourth intercostal space, whereby the spacing between said pair of contact nodes following forceful engagement automatically adjusts to achieve fitted seating of said pair of contact nodes within said third and fourth intercostal space.

It is a particular object of the present invention to provide a method as above identified, whereby said attachment interface is engaged to said third and fourth intercostal space with an engagement force of at least 50 newtons in women, and 100 newtons in men.

It is a particular object of the present invention to provide a method as above identified, wherein said attachment interface is utilized for treatment of at least one of heart attack and angina pectoris, comprising the steps of a) identifying a patient experiencing at least one of heart attack and angina pectoris, b) forcefully engaging said pair of contact nodes to the anatomic left third and fourth intercostal space, and c) simultaneously oscillating said pair of contact nodes towards and away from said anatomic left third and fourth intercostal space at a frequency between 1-1000 Hz, and a stroke length of at least 1 mm, whereby prior to completion of the step of simultaneously oscillating said pair of contact nodes, the spacing between said pair of contact nodes automatically adjusts to achieve optimized fitted seating of said pair of contact nodes upon said third and fourth intercostal space, and whereby said simultaneously oscillating said pair of contact nodes upon said third and fourth intercostal space improves coronary flow.

It is a particular object of the present invention to provide a method as above identified, wherein said attachment interface is utilized for treatment of coronary artery disease, comprising the steps of a) identifying a patient with coronary artery disease in need of induced coronary arterial growth, b) forcefully engaging said pair of contact nodes to the anatomic left third and fourth intercostal space, and c) simultaneously oscillating said pair of contact nodes towards and away from said anatomic left third and fourth intercostal space at a frequency between 1-1000 Hz, and a stroke length of at least 0.1 mm, whereby prior to completion of simultaneously oscillating said pair of contact nodes, at least one of said pair of contact nodes automatically migrates in relation to the other to achieve optimized fitted seating of said pair of contact nodes upon said third and fourth intercostal space, and whereby said oscillating said pair of contact nodes upon said third and fourth intercostal space induces new coronary arterial growth.

It is a particular object of the present invention to provide a method as above identified, wherein said attachment interface is utilized for treatment of at least one of heart failure and cardiogenic shock, comprising the steps of a) identifying a patient experiencing at least one of heart failure or cardiogenic shock, b) forcefully engaging said pair of contact nodes to the anatomic left third and fourth intercostal space, and c) simultaneously oscillating said pair of contact nodes towards and away from said anatomic left third and fourth intercostal space at a frequency between 1-1000 Hz, and a stroke length of at least 1.0 mm, whereby prior to completion of simultaneously oscillating said pair of contact nodes, the spacing between said pair of contact nodes automatically adjusts to achieve optimized fitted seating of said contact nodes upon said third and fourth intercostal space, and whereby said simultaneously oscillating said pair of contact nodes upon said third and fourth intercostal space improves left ventricular performance in remediation of heart failure or cardiogenic shock.

It is a particular object of the present invention to provide a method as above identified, wherein said attachment interface is utilized for treatment of arrhythmia, a) identifying a patient experiencing a cardiac arrhythmia, b) forcefully engaging said pair of contact nodes to the anatomic left third and fourth intercostal space, and c) simultaneously oscillating said pair of contact nodes towards and away from said anatomic left third and fourth intercostal space at a frequency between 1-1000 Hz, preferably 20-80 Hz, and a stroke length of at least 0.1 mm, and preferably greater than or equal to 1 mm, whereby prior to completion of simultaneously oscillating said pair of contact nodes, at least one of said pair of contact nodes automatically alters its position in relation to the other to achieve optimized fitted seating of said pair of contact nodes upon said third and fourth intercostal space, and whereby said simultaneously oscillating said pair of contact nodes upon said third and fourth intercostal space assists in converting said arrhythmia.

It is a particular object of the present invention to provide a method as above identified, wherein said attachment interface is utilized for clearing pulmonary congestions, comprising the steps of a) identifying a patient with pulmonary congestions, b) forcefully engaging said pair of contact nodes to a pair of rib-spaces upon the chest wall, and c) simultaneously oscillating said pair of contact nodes towards and away from said pair of rib-spaces at a frequency between 1-1000 Hz, and a stroke length of at least 1.0 mm, whereby following forceful engagement of said pair of contact nodes, at least one of said pair of contact nodes automatically alters its position in relation to the other to achieve optimized fitted seating of said pair of contact nodes upon said pair of rib-spaces and whereby said oscillating said pair of contact nodes within said pair of rib-spaces assists in clearance of said pulmonary congestions.

It is further particular aspect of the present invention to provide a vibratory attachment interface enabling transmission of oscillations generated by a percussion device via said contact interface locally upon an external human chest wall surface, said attachment interface comprising a support member disposing a first contact node and a second contact node slideably mounted alongside said first contact node, wherein said first and second contact node are each configured to enable seating within a human adult rib-space and are semi-rigidly spaced relative to one another to generally match the distance separating a human adult left third and left fourth intercostal space generally proximate a left sternal margin, and whereby following forced engagement of said first contact node upon a first leftward intercostal space, said second contact node automatically migrates to match the position of a second differing and immediately opposing leftward intercostal space, thereby enabling optimized nestled seating of said second contact node within said second differing and immediately opposing leftward intercostal space.

It is further particular aspect of the present invention to provide a vibratory attachment interface of the above type, wherein at least said second contact node has a convex contact surface, such as to enable substantially snug, opposed seating within said second differing and immediately opposing leftward intercostal space.

It is further particular aspect of the present invention to provide a vibratory attachment interface of the above type, wherein an engagement center of said first contact node and an engagement center of said second contact node are semi-rigidly spaced in the range of 2.75 cm and 3.50 cm apart prior to forced engagement of said interface, and are thereafter spaced in the range of 2.0 cm to 4.00 cm apart following forced engagement of said interface.

It is further particular aspect of the present invention to provide a vibratory attachment interface of the above type, wherein an engagement center of said second contact node slides at least 1.0 cm relative to an engagement center of said first contact node following forced engagement of said interface.

It is further particular aspect of the present invention to provide a vibratory attachment interface of the above type, wherein said second contact node is semi-rigidly held in position by at least one of a spring and an elastic.

It is further particular aspect of the present invention to provide a vibratory attachment interface of the above type, wherein said support member comprises a slit and a slideable member disposed upon said slit, whereby said slideable member operatively attaches said second contact node.

It is further particular aspect of the present invention to provide a method for using the vibratory attachment interface as above identified, said method comprising the steps of a) positioning said attachment interface over a human adult anterior chest wall such that said first contact node generally overlies the anatomic left fourth intercostal space and said second contact node generally overlies the anatomic left third intercostal space, and then b) forcefully engaging said first and second contact node upon said fourth and third intercostal space, whereby said second contact node following engagement automatically slides from its initial semi-rigid position to achieve substantially opposed seating upon said third intercostal space.

It is further particular aspect of the present invention to provide a method for using the vibratory attachment interface as above identified, said method comprising the steps of a) positioning said attachment interface over a human adult anterior chest wall such that said first contact node generally overlies the anatomic left third intercostal space and said second contact node generally overlies the anatomic left fourth intercostal space, and then b) forcefully engaging said first and second contact node upon said third and fourth intercostal space, whereby said second contact node following engagement automatically slides from its initial semi-rigid position to achieve substantially opposed seating upon said fourth intercostal space.

It is a further particular aspect of the present invention to provide a method for using the vibratory attachment as above identified, comprising the steps of, a) emitting vibration at a frequency between 1-1000 Hz and an oscillation amplitude between 0.1-10 mm through said attachment interface, and b) engaging said first and second contact node of said attachment interface upon an anatomic left third and left fourth intercostal space of an individual prior to completion said emitting vibration, whereby said vibration is thereby transmitted via said attachment interface to said left third and left fourth intercostal space, and whereby the spacing between said first and second contact node automatically adjusts following said engaging said first and second contact node to provide optimized fitted seating upon said left third and fourth intercostal space, and whereby said vibration is timed to occur during the diastolic period of a cardiac cycle, and is turned off during the systolic phase of the cardiac cycle, and whereby said vibration is utilized for treatment of at least one of; heart attack, angina pectoris, coronary artery disease by induction of new coronary arterial growth, heart failure, cardiogenic shock, and combinations thereof.

It is a general object of the present invention to provide a method for improving blood flow within the thoracic cavity, comprising the steps of a) providing a pair of contacts, each sized and shaped to enable seating within a human adult rib-space, b) simultaneously and forcefully engaging said pair of contacts upon an anatomic left third and fourth intercostal space, c) allowing the spacing between said pair of contacts to automatically change to provide an optimized, fitted position upon said anatomic left third and fourth intercostal space, and d) vibrating said pair of contacts at a frequency between 1-1000 cycles per second and an oscillation amplitude in the range of 1.0-10 mm upon said anatomic left third and fourth intercostal space, whereby said optimized fitted position of said pair of contacts enables optimized transmission of vibration from the chest wall to the heart, such as to improve blood flow within the thoracic cavity, and whereby vibration of said pair of contacts is initiated at any time prior, during or after said engaging said pair of contacts (or equivalently initiated at any time following said providing said pair of contacts).

It is another general object of the present invention to provide a method as above identified, wherein said vibration is applied during the diastolic period of the cardiac cycle, and substantially turned off during the systolic period of the cardiac cycle.

It is another general object of the present invention to provide a method as above identified, wherein said improved blood flow within the thoracic cavity relates to improved myocardial perfusion.

It is another general object of the present invention to provide a method as above identified, wherein said improved blood flow within the thoracic cavity relates to improved cardiac performance, such as in treatment of at least one of: heart failure, cardiogenic shock or conversion from a hemodynamically unstable arrhythmia.

BRIEF DESCRIPTION OF THE DRAWINGS

The apparatus and method of the present invention will now be described with reference to the accompanying drawing figures, in which.

DETAILED DESCRIPTION

Figure 1:
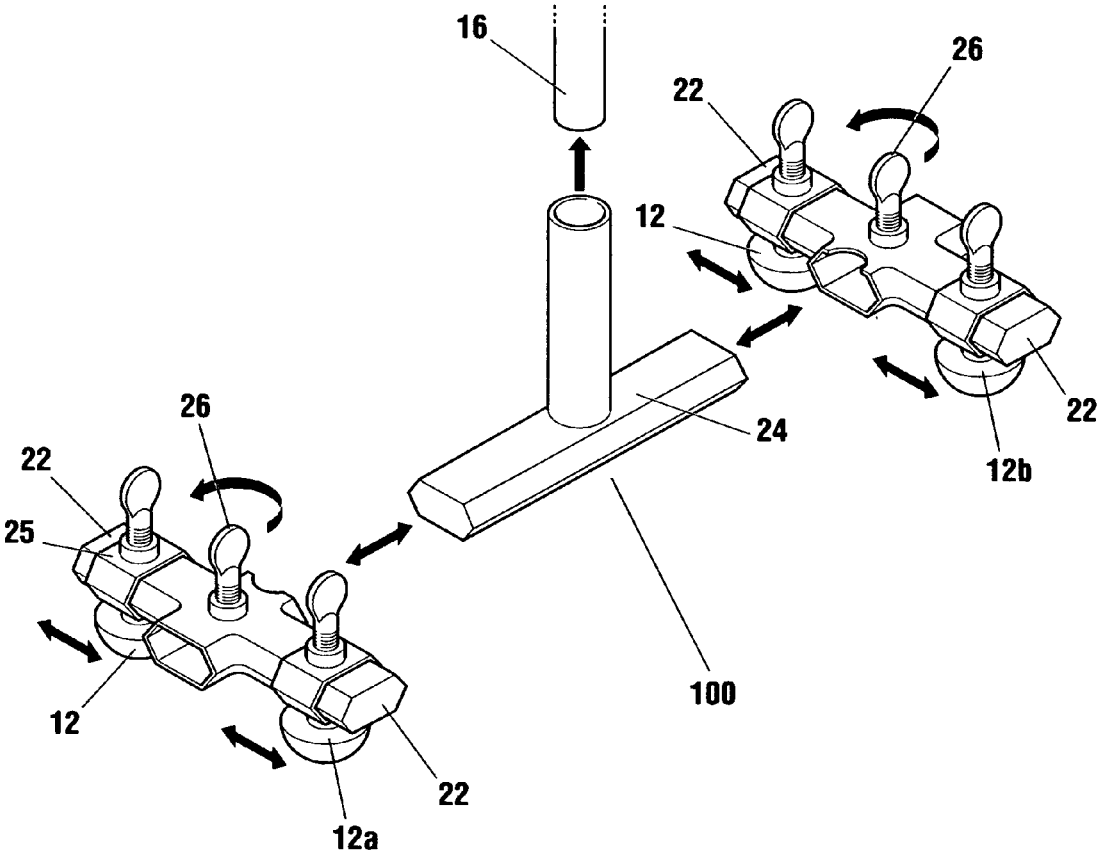
FIG. 1 is a perspective view of a vibratory attachment interface disclosed in an earlier co-pending application belonging to the applicant, comprising an elongate support member having two pairs of slideable support arms, each support arm disposing a pair of contact nodes.

The present invention relates to an improvement to the design of vibratory contact interface 100, as disclosed by the applicant in co-pending U.S. patent application Ser. No. 12/154,508, with the added feature of an adapted, automatically slide-able (or moveable), anatomic leftward oriented contact node, which in a single step upon forced engagement of the contact interface upon a chest wall surface (such as across the sternum at the fourth intercostal space, at or near the sternal margins), offers automatic migration to achieve substantially flush, opposed seating within an immediately opposing leftward intercostal space (such as the left third intercostal space, near the left sternal margin).

In its preferred use, the improved contact interface (hereinafter "automatic adjusting contact interface") is to be applied such that a pair of contact nodes are seated to the anatomic left and right of the sternum at the level of the fourth intercostal space at or near (within a few centimeters) the sternal margin. Upon such positioning, a second leftward oriented contact node will, in a single step (without need of a manual adjustment), automatically gravitate to achieve substantially opposed and flush seating within an immediately opposing anatomic left third intercostal space, at or near the left sternal margin. Therefore once engaged, automatic adjusting contact interface advantageously provides contact to the anatomic left and right of the sternum fourth intecostal space (at or near the sternal margin), and also provides contact to the anatomic left third intercostal space (at or near the left sternal margin), which in total comprises an ideal vibratory transmission pathway from the chest wall to the heart, and coronary arteries thereupon.

Automatic adjusting contact interface enables a range of variable automatic spacing between at least the anatomic leftward oriented pair of contact nodes, such as to accommodate a range of human individuals (or patients), with differing opposing rib-space separation distances.

Automatic adjusting contact interface has many uses in treatment of cardiovascular ailments within the thoracic cavity. One important use is in a first line emergency response system and apparatus for pre-hospital or initial in-hospital treatment of patients experiencing an acute thrombotic coronary obstruction and/or associated vessel spasm. The emergency application of high amplitude, noninvasive, transcutaneously imparted LLFV, optimally as a synergistic adjunct to systemically delivered drug therapy, for lysing and vasodilating acute coronary thrombotic obstructions, relieving spasm (if associated), and thereby restoring blood perfusion is disclosed. The invention is particularly effective against thromboses in the thoracic/mediasteinal cavity.

LLFV shortens the onset and accelerates the effectiveness of thrombolytics. Due to the urgency to treat heart attacks and pulmonary emboli, as cell death is directly proportional to time, it is of utmost importance to enhance the onset and accelerate the effectiveness of the imparted drug treatment in lysing or clearing vascular obstructions. The noninvasive application of LLFV, in addition to its potential immediate availability to expedite emergency treatment, has the further advantage of not causing undue heating of the overlying tissue superficial to the site of vascular obstructions. Furthermore, the localized biophysical nature of LLFV treatment is advantageous in that as it is not a drug, it will not cause adverse systemic biochemical effects, which can otherwise be difficult to reverse such as hemorrhage.

The term "vibration" according to the present invention relates broadly to a repetitive back and forth movement of an attachment interface (or vibratory contact, or contact node) to be applied to or strike against (or percuss) a body surface of a patient, and should not be construed to mean, or be limited to any particular form of vibration unless otherwise specified. The term "localized" (as in localized vibration) refers to vibration applied to a part of a body (such as the chest wall surface), and not the whole entire body at once. The term "opposed" (as referred to in placing, or enabling placement of a contact surface of a contact node in direct opposition to, or face to face with, an intercostal space) means substantially snug, flush, or alternatively fitted or face to face seating of such contact surface (or any part thereof) upon (or equivalently within) an intercostal space.

The emergency response system, or "Vibrinolytic Therapy", involves the application of non-invasive Diastolic LLFV with an emission frequency of 1-1000 Hz, preferably 20-120 Hz, more preferably 50 Hz and optimally via incorporation of "Randomic LLFV" (whereby the frequency of LLFV is randomly altered in the 20-80 Hz range) to the chest wall (preferably across the sternum at the fourth intercostal space, and proximate the left sternal margin at the third intercostal space) as an adjunct to thrombolytic therapy in the treatment of ST Elevation Myocardial Infarction ("STEMI"). A source output oscillation amplitude, or stroke length ranging from 0.1 up to 10 mm is selectively provided in the 1-120 Hz range. The emergency response system is not complicated and can be applied by a minimally trained paramedic or nurse without the need for special skilled imaging guidance or targeting. Vibrinolytic therapy can also be used without thrombolytic drug therapy, whereby chest wall LLFV may work synergistically with blood thinning medications like heparin, ASA, and/or GP 2b 3a platelet inhibitors.

LLFV is imparted to the chest and thereby by transmission to the epimyocardium of the heart and coronary arteries. The application is particularly effective for the treatment of STEMI. LLFV therapy can, with or without drug delivery, also be utilized for other forms of acute coronary syndromes such as Non Q wave (i.e. "Non ST elevation") MI or Unstable Angina where symptoms are otherwise refractory to medical management.

There are four primary effects of Vibrinolytic Therapy. First, thromboses or clots are disrupted as the mechanical agitation creates sheer stresses due to cavitation and sonic streaming and thereby loosens or breaks apart the clot, resulting in increased fibrin binding sites, and improved lytic penetration. Second, sonic streaming (unidirectional motion of fluid in a vibration field) and convection currents aid the diffusion process and promote mixing of intravenous drugs from the systemic circulation to the occluded, zero flow culprit vessel. Third, coronary vasodilatation within the culprit circulation is achieved as the smooth muscle within the thrombosed, often spasming coronary artery wall is relaxed by vibration (due to a vibration induced decoupling of the actin-myosin filaments of the sarcomere). Fourth, vibration cause disadhearment of a blood clot from the endothelial surface of a rupture plaque within a culprit coronary artery, allowing it to clear distally to smaller vessels and thereby allowing reflow in the main large culprit vessel. Secondary therapeutic effects include a localized endogenous release of tissue plasminogen activator, an improved left ventricular ("LV") myocardial relaxation with a lowering of LV diastolic pressures (and thus potential improvements to diastolic, transmural coronary flow), the potential for a positive inotropic effect (leading to an increased lytic filtration pressure which is particularly useful in cardiogenic shock cases), the potential for decreased myocardial oxygen demand for equal contractility, an improvement of lung/gas oxygen exchange (to provide additional oxygen to the heart and help relieve ischemic burden), and decreased blood viscosity.

Randomic LLFV further enhances disruption and mobilization of coronary thrombosis, as the randomized vibration introduces increased levels of turbulence and multi directional shear forces within the blood of the treated coronary artery, which improves disruption and dissolution of the culprit coronary thrombosis, and further enhances mixing of introduced clot dissolving blood agents from the systemic circulation down the occluded, otherwise zero flow culprit coronary circulation.

Chest wall LLFV can also be used in chronic therapy to induce coronary angiogenesis (hereinafter "Vibroangiogenic Therapy"), or more broadly induce new coronary arterial growth (such as growth of pre-existing collaterals). It has been established that localized sheer stresses upon the endothelium of arteries up-regulates beneficial angiogenic mediators which induce new arterial growth. Vibroangiogenic Therapy to the chest wall induces such an affect upon a diseased coronary vasculature, thereby inducing angiogenesis. Turbulent blood flow (such as following a stenosis site within an artery) is particularly known to upregulate beneficial mediators, hence Randomic LLFV comprises a preferred application for Vibroangiogenic Therapy.

Chest wall Diastolic LLFV also, by improved left ventricular relaxation, provides improvement to left ventricular performance (both systolic and diastolic function), such as in treatment of heart failure or cardiogenic shock (hereinafter, "Vibro-Left Ventricular Assist Therapy").

Figure 2:
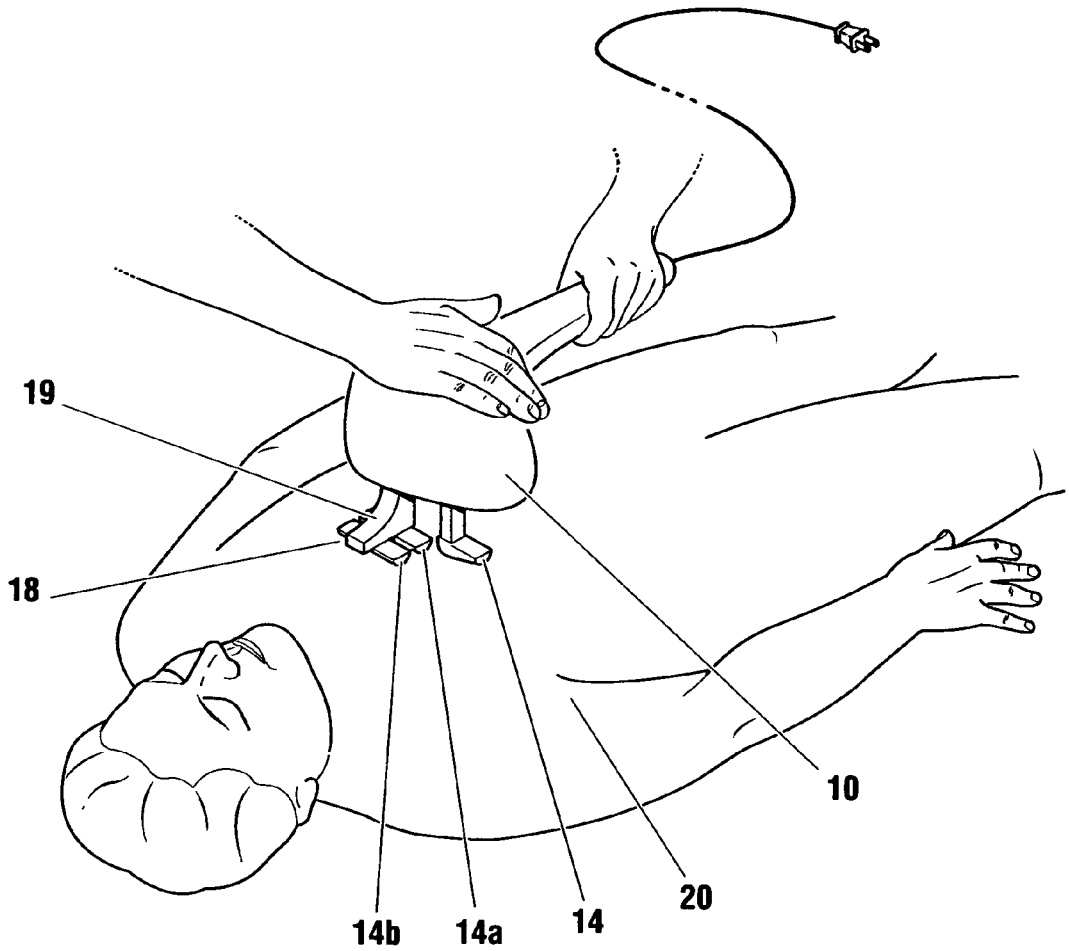
FIG. 2 is a perspective view of the preferred automatic adjusting contact interface applied to a patient undergoing vibration therapy for blood blow disturbances within the thoracic cavity.

Referring to FIG. 2, a patient 20 undergoing Vibrinolytic, Vibroangiogenic, or Vibro-Left Venrtricular Assist Therapy according to the preferred embodiment is shown (IVs, drugs, nasal prongs and monitoring equipment etc. which may or not be required in select instances are not shown). The preferred engagement means, the hands of an operator, for applying LLFV via preferred vibrator 10 to the patient 20 is shown.

An anatomic leftward oriented vibratory support member 19 which disposes the anatomically leftward contact nodes—including stationary contact 14*a* and moveable contact 14*b*, comprise the automatic adjusting contact interface 18 of the preferred vibrator 10, which is placed at the treatment site upon the anterior chest wall (preferably the anatomic left third and fourth intercostal space, proximate the left sternal margin) of patient 20. An anatomic rightward oriented stationary contact 14 is also shown, such as to enable preferred engagement of contact node 14 to the anatomic right of the sternum (such as at the fourth intercostal space).

Upon forced engagement of vibrator 10 by force F, leftward oriented automatically moveable contact 14*b* automatically, without a manual adjustment step, gravitates to an optimized, substantially flush, opposed position within the anatomic third intercostal space generally proximate (i.e. within a 3 or 4 centimeters) the left sternal margin, and vibration to the chest wall at high displacement amplitude and engagement force (preferably the highest tolerable and judged safe to patient 20) is thereby initiated to effect therapy.

The anatomic left third intercostal space is generally situated closest to the base of the heart wherein the coronaries arise (but is sometimes acoustically blocked by lung which does not transmit acoustic energy), and the anatomic left fourth intercostal space is generally just inferior to the base of the heart, but is situated away from lung hence is the most reliable acoustic window for administration of chest wall LLFV therapy. LLFV applied across the sternum by contact node 14 and 14*a* is advantageous as the configuration generally matches the anatomic location of the left and right coronary artery (which bifurcates to the anatomic left and right of the sternum with patient 20 in the supine position). LLFV across the sternum is further beneficial because it provides a more stable support for vibrator 10 when resting upon a chest wall surface.

It is desirable to achieve substantially opposed, flush (or fitted) seating of contacts 14*a* and 14*b* primarily within the anatomic left $3^{rd}$ and $4^{th}$ intercostal space (or equivalently between the left $3^{rd}$ and $4^{th}$ rib, and between the left $4^{th}$ and $5^{th}$ rib) as opposed to primarily upon the ribs themselves, as it is uncomfortable (and sometimes a bit painful) for chest wall LLFV therapy to commence with a vibratory contact surface (which effects percussion) primarily upon, or substantially upon, a rib. It is thereby preferable for patient comfort concerns to have at least the majority of a vibratory contact surface within a rib-space, such as to primarily engage the soft tissue between the ribs, with only the outer margins of the contact surface resting tangentially against opposing ribs—which secures the engagement position and allows nestling of a contact node within a selected rib-space.

Furthermore, substantially opposed, flush contact of a vibratory contact surface primarily within a rib-space (as apposed to primarily upon a rib) enables superior vibratory transthoracic transmission, as a patient can tolerate higher levels of engagement force and oscillatory displacement amplitudes (or stroke length) of vibration therapy at a given frequency.

Figure 3A:
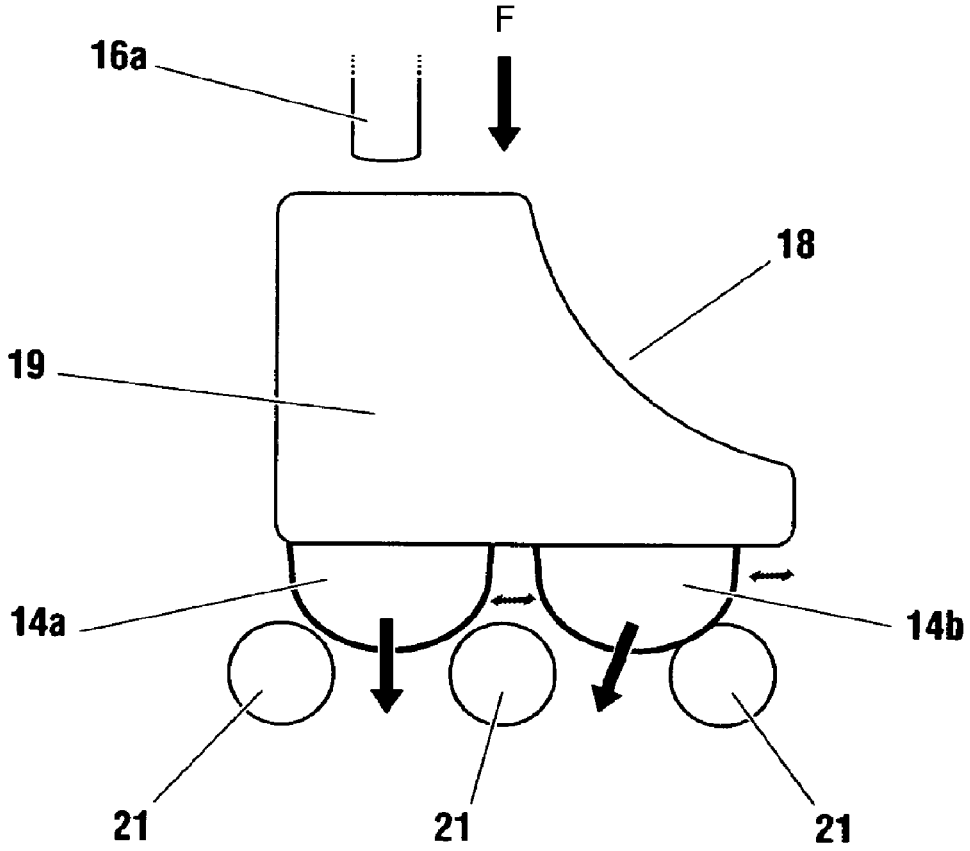
FIG. 3*a* is a side view of the preferred automatic adjusting contact interface prior to engagement to a pair of directly opposing rib-spaces.

Referring now to FIG. 3*a*, a side view of the preferred automatic adjusting contact interface 18 prior to engagement to a pair of directly opposing anatomic leftward rib-spaces defined by directly opposing ribs 21 is shown. Automatic adjusting contact interface 18 is generally engaged upon or over the skin (skin not shown) of the anatomic left third and fourth intercostal space, whereby contact 14*a* stemming from vibratory support member 19 is nestled optimally (i.e. via substantially flush, opposed seating) within a fourth intercostal space, but moveable contact 14*b* is sub-optimally seated substantially upon a rib, directly adjacent and superior to the third intercostal space.

Figure 3B:
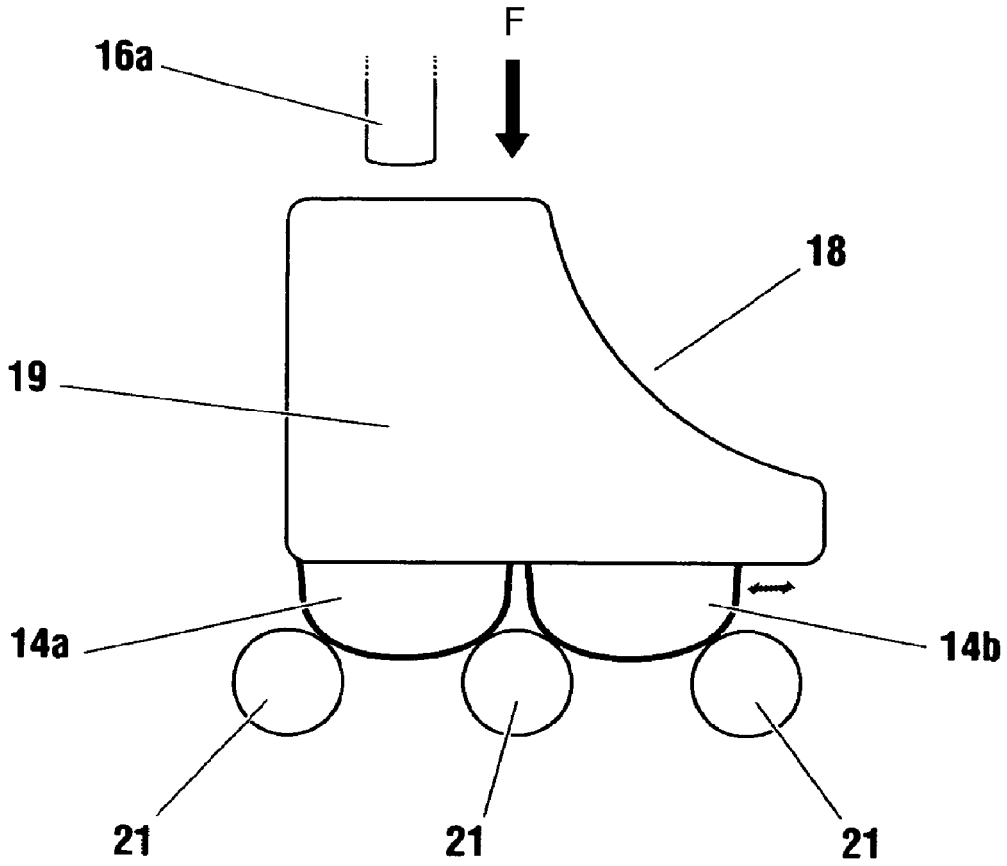
FIG. 3*b* is a side view of the preferred automatic adjusting contact interface following forced engagement to a pair of directly opposing rib-spaces.

Upon applying force F to automatic adjusting contact interface 18 upon the chest wall, and in reference to FIG. 3*b*, moveable contact node 14*b* automatically gravitates to a substantially opposed, flush, fitted position within the third intercostal space.

Vibratory support member 19 is advantageously configured in an angle bracket fashion, so transmission of vibration from a vibrator post 16*a* (showed disengaged from vibratory support member 19) of vibrator 10 (vibrator 10 not shown in this view) can be best, and most durably, transmitted to contact node 14*a* (which is directly below vibratory post 16*a*) as well as moveable contact 14*b* which is disposed remote from vibratory post 16*a*.

Figure 4:
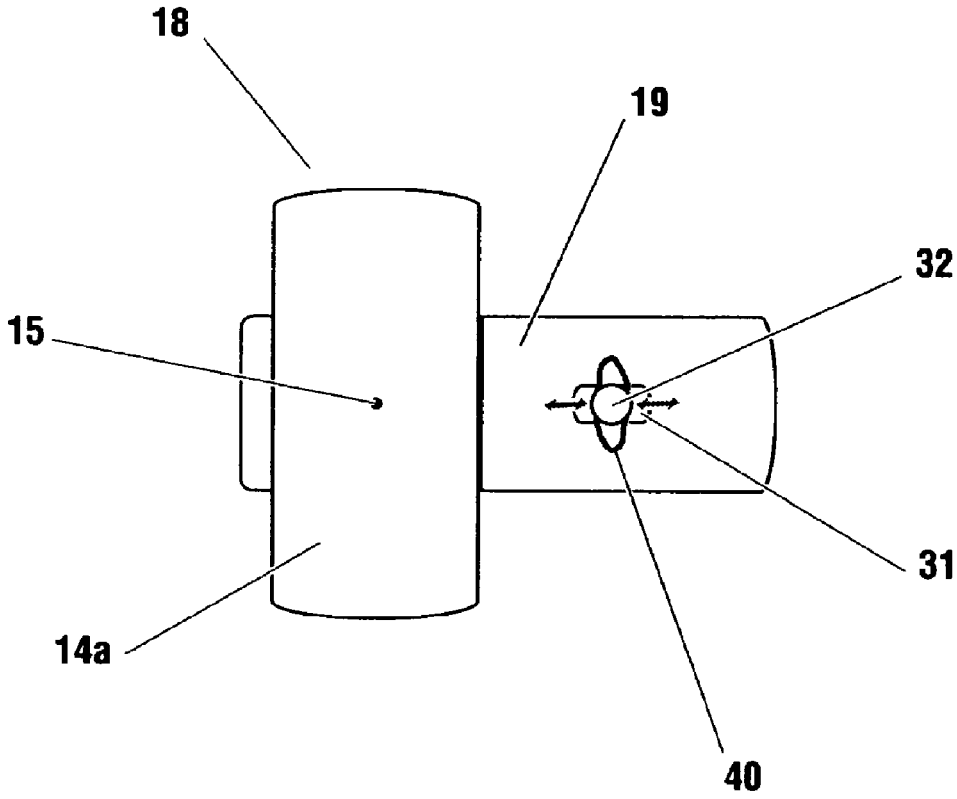
FIG. 4 is a view of the underside of the preferred automatic adjusting contact interface with the moveable contact node removed.

In reference to FIG. 4, an underside view of the preferred automatic adjusting contact interface 18, with contact 14*b* removed, is shown. A slit 31 within vibratory support member 19 defines a slideable support for attachment post 32 which attaches moveable contact node 14*b* (not shown), whereby the attachment post 32 can thereby move towards or away from contact node 14*a*, along slit 31.

Attachment post 32 is semi-rigidly positioned by an elastic band 40 that is advantageously mounted exterior the underside of vibratory support member 19 (hence easily replaced in case of breakage) and which encircles (and thereby semi-rigidly supports) attachment post 32 at the center of slit 31. Elastic band 40 is of elasticity and constitution such that it enables movement of attachment post 32 to the edges of slit 31 with a minimal application of force, thereby enabling movability of contact node 14*b* away or towards contact node 14*a*.

The present invention envisions a male and a female variety of automatically adjustable contact interfaces 18 whereby the initial semi-rigid spacing (prior to engagement to a chest wall surface) of contacts 14*a* and 14*b* differ to accommodate for average rib-space separation differences between the sexes. In a male version, a center engagement point of contact 14*b* (not shown) is semi-rigidly positioned (such as by placement of elastic band 40) between 2.75 cm and 3.75 cm, and optimally 3.25 cm from a center point 15 of contact 14*a*. In a female version, a center engagement point of contact 14*b* (not shown) is semi-rigidly positioned between 2.5 cm and 3.5 cm, and optimally 3.0 cm, from the center point 15 of contact 14*a*.

Slit 32 defines a one centimeter length wise opening through the underside of vibratory support member 19, thereby enabling slideable movement of moveable contact node 14*b* one centimeter towards or away from contact node 14*a*.

Contact nodes 14, 14*a* and 14*b* have a slightly curved (convex shaped) contact surface, such as to enable substantially opposed, snug seating within a human adult rib-space. Contact nodes 14, 14*a* and 14*b* advantageously also have a contact surface "length" (enabling rib-space engagement in a medial to lateral position) which is at least double its contact surface "width" (enabling rib-space engagement in a superior to inferior position). Such configuration of contact surface "length" of at least double contact surface "width" provides increased coverage (surface area) of contact nodes 14, 14*a* or 14*b*, within any selected rib-space, which further adds to optimize transthoracic penetration of a LLFV signal to the heart. It should be understood that the requirement of having a contact node contact surface "length" at least double its "width" is not critical to the function of the invention, and any one or all of contact nodes 14, 14*a* or 14*b* (or all) may incorporate this feature.

It should be understood that the present invention also contemplates and includes inclusion of a suitable vibrator 10 which enables operative attachment to the automatic adjusting contact interface 18, such as to enable automatic adjusting contact interface 18 to vibrate.

Vibrator 10 (or percussion device by other name) enables linear reciprocating motion of vibratory post 16*a*, at a frequency between 1-1000 Hz and preferably in the range of about 20-120 Hz (such as to generally match the resonance frequency of the epimyocardium of the heart which holds the coronary arteries thereupon), and an oscillatory displacement amplitude (or stroke length) in the range of 0.1-10 mm, and preferably at least 1 mm, (such as to ensure satisfactory vibratory force to transmit from the chest wall to the heart). Vibrator 10 also advantageously enables Randomic Vibration with random frequency alterations in the 20-80 Hz range, which comprises the preferred LLFV therapy for treatment of STEMI and stimulating coronary angiogenesis.

Vibrator 10 weighs about 10 lbs in a female version (such as to enable a "hands free' engagement force of at least about 50 newtons—with vibrator 10 merely resting (without an operator pressing) on a chest wall surface. Vibrator 10 weights about 20 lbs in a male version, such as to enable hands free engagement force of at least about 100 newtons in a male version.

It should be understood that the weight of vibrator 10 is not crucial, and could in a variation be made very light (such as about 2 or 3 lbs), but then there would be an added absolute requirement of an operator to continually press down on the device (such as to achieve 50 to 100 newtons of engagement force—such as for women and men respectively), which may be difficult to accomplish when or if the patient is being transported on a stretcher. Vibrator 10 also preferably has a motor which is operable (i.e. the motor will not stall or slip) at engagement loads of 100 newtons.

Vibrator 10 is preferably integrated with an ECG monitor (or alternatively a plethysmograph, or pulse oximeter) to enable ECG gated timing—and thereby administration of Diastolic LLFV. Vibrator 10 is also most preferably integrated with a portable pacer/defibrillator system such as to best enable paramedic use in the field, such as in pre-hospital thrombolysis applications in treatment of STEMI.

In preferred operation of vibrator 10 together with automatic adjusting contact interface 18, vibrator 10 is first turned on, such as to simultaneously vibrate contact nodes 14, 14*a* and 14*b* at the selected vibratory waveform setting (preferably 6 mm oscillation amplitude for men, and 4 mm oscillation amplitude for women, with preferably Randomic LLFV with a random frequency fluxuation emitted in the 20-80 Hz range).

Diastolic LLFV is preferably utilized for treatment of STEMI, angina pectoris, or in any condition where heart failure or cardiogenic shock may be present or expected.

Vibrator 10 is then (while in operation) gently and very slowly placed upon the skin of the chest wall of patient 20, whereby patient 20 is preferably lying in a supine position, but maybe partially seated upright when short of breath. Contacts 14*a* and 14 are gently placed upon the anatomic left and right fourth intercostal space respectively, near the sternal margin (such as to make substantially flush, opposed contact with the anatomic left and right fourth intercostal space), with contact node 14*b* generally applied over the left third intercostal space, also generally near the left sternal margin. Then vibrator 10, along with automatic contact interface 18, is more forcefully applied to the chest wall surface (such as by the weight of vibrator 10), whereby contact node 14*b* automatically adjusts its location relative to contact node 14*a*, to advantageously achieve substantially flush, opposed seating within the anatomic left third intercostal space, generally near the left sternal margin.

At first, only the weight of vibrator 10 is utilized for engagement force, whereby tolerance of the LLFV treatment is then gauged by reaction (such as articulation of potential discomfort) from patient 20. Once patient 20 is comfortable (or has become accustomed to the LLFV application—which has a gradual numbing effect), further engagement force, preferably by hand, is preferably applied when tolerated against vibrator 10 upon the chest wall surface of patient 20 to maximize LLFV transthoracic penetration. Increased engagement force, particularly with vibrator 10 in operation, further facilitates gravitation of contact node 14*b* to an optimally nestled, snug, fitted position within the left third intercostal space. The use of Lidocaine or other topical anesthetic may be utilized for select cases in women, who cannot otherwise tolerate chest wall LLFV therapy.

It should be understood that while vibrator 10 is preferably turned on prior to chest wall engagement, the order of this step is not critical and alternatively vibration could also be initiated during or following chest wall engagement.

Many modifications are possible to the emergency system without departing from the spirit or innovative concept of the invention.

In particular reference to the workings of automatic adjusting contact interface 18, other recoiling mechanisms other than elastic band 40 could be utilized, such as a pair of opposing elastic bands, or a pair of opposing springs mounted inside or upon vibratory support member 19—or any other known means which could provide force to hold attachment post 32 semi-rigidly in place in an elastic manner or recoilable manner, which also enable attachment post 32 to slide subsequent to the application of minimal force.

Also, while the preferred embodiment shows a fixed contact node 14*a* (for placement to the left fourth intercostal space) and a moveable contact node 14*b* (for automatically adjusting seating within the left third intercostal space), equivalently the configuration could be reversed so the moveable contact comprised seating to the fourth intercostal space, and the fixed contact node could be seated to the third intercostal space. In a further variation, it could be entirely possible if both anatomically leftward oriented contact nodes where semi rigidly positioned and both moveable relative to one another.

Also, while the preferred embodiment shows a pair of contact nodes which are "slideable" relative to one another upon vibratory support member 19, the current invention envisions other possibilities whereby at least a pair of contact nodes can more broadly move or migrate away from or towards one anther (and not necessarily slide), upon application of force. For example a pair of contact nodes could be disposed rigidly on an adjustably spaced pair of supports, rather than being slideable upon such a support.

Furthermore, while the preferred embodiment shows an application of three contact nodes, 14, 14*a*, 14*b*, such as to enable simultaneous seating to the anatomic left and right of the sternum at the fourth intercostal space, and simultaneous seating via specific use of automatic adjusting contact interface 18 to the left third intercostal space proximate the left sternal border, alternatively four contact nodes (two "stationary" and two "moveable") could be used such as to enable bridging of the sternum and the left and right third and fourth intercostal space, or even greater than 4 contact nodes could be utilized, such as up to 6 contact nodes (any one of which may be "moveable" and thereby automatically adjustable), such as to enable seating to the anatomic left and right of the third, fourth and fifth intercostal space. The latter variation may be useful in particular with patients with advanced COPD, whereby lower rib-spaces (such as the fifth intercostal space) may be useful such as to get away from lung, which is enlarged and often acoustically shields the heart from both the third and fourth intercostal space.

It is also possible, but not preferred, that only automatic adjusting contact interface 18 be used to vibrate only the anatomic left third and fourth intercostal space (or in COPD cases the left fourth and fifth intercostal space), without a complimentary contact node interfacing with the anatomic right fourth intercostal space.

It should also be understood that while the preferred embodiment has contact nodes 14, 14*a* and 14*b* applied directly upon the skin of patient 20, this is not absolutely essential according to the operation of the invention. Contact nodes 14, 14*a* and 14*b* can be alternatively applied over a shirt, towel or equivalent piece of clothing (or other such apparel) overlying a chest wall surface, whereby once forcefully applied, contact nodes 14*a* and 14*b* can still alter their spacing relative to one another to enable substantially fitted, contoured seating upon their targeted opposing rib-spaces (such as the anatomic left third and fourth intercostal space at or near the left sternal margin), as long as the contour of such chest wall surface is not completely blunted or nullified by such overlying apparel.

It should be understood that while the preferred embodiment shows automatic adjusting contact interface 18 projected from the main casing of vibrator 10 via attachment to vibrator post 16*a* (which is mechanically linked to a reciprocating motor within the casing of vibrator 10—not shown), this arrangement is not critical according to the invention and is shown for illustration purposes only. Equivalently an alternative vibratory support for contact nodes 14, 14*a*, and 14*b* (or any part thereof) could be integrated directly within or upon the main casing of vibrator 10, such as directly on the underside of the casing or to substantially form the underside of the casing, without need of an attachment from vibratory post 16*a* (or an equivalent) which stems and projects from the underside of the main casing of vibrator 10. Also, while the preferred embodiment shows that all contact nodes 14, 14*a* and 14*b* have a substantially convex contact surface (such that all contact nodes may thereby seat snuggly within an intercostal space), it is only absolutely necessary in the function of the present invention that moveable contact node 14*b* is so configured.

Finally, while the invention contemplates use of chest wall LLFV for treatment of acute coronary thrombosis, remediation of angina through induction of coronary angiogenesis, and treatment of heart failure or cardiogenic shock, there are many other useful purposes for chest wall LLFV.

For example, chest wall LLFV can be used for treatment of arrhythmia (hereinafter "Vibro-Arrhythmic Therapy" wherein a patient is refractory to medical management by anti-arrhythmic drugs, and/or hemodynamically unstable as a substitute or first measure prior to administration of DC cardioversion. Chest wall vibration (which is equivalent to a gentle plurality of pre-cordial thumps) may be attempted in treatment of PSVT, VT, or to convert atrial fibrillation—however if used in atrial fibrillation it is advisable that the patient be anticoagulated prior to use. Also chest wall LLFV can be used very effectively in mobilizing pulmonary secretions, such as in cystic fibrosis cases.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

I claim:

1. A vibratory attachment interface operable to transmit oscillations generated by an oscillation source to an external human chest wall surface, said attachment interface comprising:

a support member comprising a first and a second contact node, wherein said first and second contact nodes are sized and spaced to overly and operable to simultaneously seat upon an adult anatomic left third intercostal space and an adult anatomic left fourth intercostal space generally proximate the left sternal margin, and an oscillation source operatively attached to said attachment interface, said oscillation source administrable to generate oscillations at a frequency between 1-1000 Hz, and a stroke length of 1.0 mm-10 mm which are thereby transmitted to said attachment interface, wherein at least one of said first and second contact nodes is semi-rigidly retained with respect to said support member such that upon application of an engagement force to said first and second contact nodes against said left third and left fourth intercostal spaces, at least one of said first and second contact nodes automatically alters its position relative to the other contact node in response to said engagement force such as to enable substantially flush, opposed seating of said first and second contact nodes within said left third and left fourth intercostal spaces.

2. The vibratory attachment interface of claim 1, wherein said first contact node is fixed in position relative to said support member, and said second contact node of said pair is slideably mounted upon said support member, thereby enabling movement of said second contact node relative to said first contact node.

3. The vibratory attachment interface of claim 1, wherein at least one of said contact nodes has a substantially convex contact surface.

4. The vibratory attachment interface of claim 1, wherein an engagement center of said first contact node and an engagement center of said second contact node are semi-rigidly positioned in the range of 2.50 cm and 3.75 cm apart prior to application of an engagement force to said interface against a chest wall surface, and wherein upon application of said engagement force to said interface against a chest wall surface, the spacing between said first contact node and said second contact node is automatically altered.

5. The vibratory attachment interface of claim 4, wherein said engagement center of said first contact node and said engagement center of said second contact node are semi-rigidly spaced in the range of 2.50 cm to 3.50 cm apart prior to application of said engagement force to said interface.

6. The vibratory attachment interface of claim 4, wherein said engagement centre of said first contact node and said engagement center of said second contact node are semi-rigidly spaced at a distance of at least 3.0 cm apart prior to application of said engagement force to said interface.

7. The vibratory attachment interface of claim 4, wherein said second contact node is operable to automatically alter its position by at least 1.0 cm relative to said first contact node following application of said engagement force to said interface against a chest wall surface.

8. The vibratory attachment interface of claim 4, further comprising a third contact node spaced in relation to said first contact node to enable simultaneous seating of said third and first contact node to the anatomic left and right of a human adult sternum, respectively.

9. The vibratory attachment interface of claim 1, wherein at least one of said contact nodes has a contact surface length enabling rib-space engagement in a medial to lateral position, which is at least twice a contact surface width enabling rib-space engagement in a superior to inferior position.

10. A method of using the vibratory attachment interface as defined in claim 1, comprising the steps of:

a) positioning said first and second contact nodes generally over the anatomic left third and left fourth intercostal spaces, respectively, near or upon the left sternal margin, and then b) applying an engagement force to said first and second contact nodes against said third and fourth intercostal spaces, respectfully, whereby the spacing between said first and second contact nodes following application of said engagement force automatically adjusts in response to said engagement force to achieve fitted seating of said first and second contact nodes within said third and fourth intercostal spaces.

11. The method of claim 10, wherein said engagement force is at least 50 newtons.

12. A method of using the vibratory attachment interface as defined in claim 1 for treatment of at least one of heart attack and angina pectoris, comprising the steps of:

a) identifying a patient experiencing at least one of heart attack and angina pectoris, b) applying an engagement force to said first and second contact nodes against the anatomic left third and fourth intercostal spaces, respectively, and c) simultaneously oscillating said first and second contact nodes towards and away from said anatomic left third and fourth intercostal spaces at a frequency between 1-1000 Hz, and a stroke length of at least 1 mm, whereby prior to completion of step 13 (c), the spacing between said first and second contact nodes automatically adjusts in response to said engagement force to achieve optimized fitted seating of said first and second contact nodes within said third and fourth intercostal spaces, and whereby said simultaneously oscillating said first and second contact nodes upon said third and fourth intercostal spaces improves coronary flow.

13. A method of using the vibratory attachment interface as defined in claim 1 for treatment of coronary artery disease, comprising the steps of:

a) identifying a patient with coronary artery disease in need of coronary arterial growth, b) applying an engagement force to said first and second contact nodes against the anatomic left third and fourth intercostal spaces, respectively, and c) simultaneously oscillating said first and second contact nodes towards and away from said anatomic left third and fourth intercostal spaces at a frequency between 1-1000 Hz, and a stroke length of at least 0.1 mm, whereby prior to completion of step 14 (c), at least one of said first and second contact nodes automatically migrates in relation to the other in response to said engagement force to achieve optimized fitted seating of said first and second contact nodes within said third and fourth intercostal spaces, and whereby said oscillating said first and second contact nodes upon said third and fourth intercostal spaces induces new coronary arterial growth.

14. A method of using the vibratory attachment interface as defined in claim 1 for treatment of at least one of heart failure and cardiogenic shock, comprising the steps of:

a) identifying a patient experiencing at least one of heart failure or cardiogenic shock, b) applying an engagement force to said first and second contact nodes against the anatomic left third and fourth intercostal spaces, respectively, and c) simultaneously oscillating said first and second contact nodes towards and away from said anatomic left third and fourth intercostal spaces at a frequency between 1-1000 Hz, and a stroke length of at least 1.0 mm, whereby prior to completion of step 15 (c), the spacing between said first and second contact nodes automatically adjusts in) response to said engagement force to achieve optimized fitted seating of said first and second contact nodes within said third and fourth intercostal spaces, and whereby said simultaneously oscillating said first and second contact nodes upon said third and fourth intercostal spaces improves left ventricular performance in remediation of heart failure or cardiogenic shock.

15. A method of using the vibratory attachment interface as defined in claim 1 for treatment of arrhythmia, comprising the steps of:

a) identifying a patient experiencing a cardiac arrhythmia, b) applying an engagement force to said first and second contact nodes against the anatomic left third and fourth intercostal spaces, respectively, and c) simultaneously oscillating said first and second contact nodes towards and away from said anatomic left third and fourth intercostal spaces at a frequency between 1-1000 Hz and a stroke length of at least 1 mm, whereby prior to completion of step 16 (c), at least one of said first and second contact nodes automatically alters its position in) relation to the other in response to said engagement force to achieve optimized fitted seating of said first and second contact nodes within said third and fourth intercostal spaces, and whereby said simultaneously oscillating said first and second contact nodes upon said third and fourth intercostal spaces assists in converting said arrhythmia.

16. A method of using the vibratory attachment interface as defined in claim 1 for clearing pulmonary congestions, comprising the steps of:

a) identifying a patient with pulmonary congestions, b) applying an engagement force to said first and second contact nodes against a pair of rib-spaces upon the chest wall, and c) simultaneously oscillating said first and second contact nodes towards and away from said pair of rib-spaces at a frequency between 1-1000 Hz, and a stroke length of at least 1.0 mm, whereby following application of said engagement force to said first and second contact nodes, at least one of said first and second contact nodes automatically alters its position in relation to the other in response to said engagement force to achieve optimized fitted seating of said first and second contact nodes within said pair of rib-spaces and whereby said oscillating said first and second contact nodes within said pair of rib-spaces assists in clearance of said pulmonary congestions.

17. A vibratory attachment interface operable to transmit oscillations generated by a percussion device via said attachment interface to an external human chest wall surface, said attachment interface comprising:

a support member comprising a first contact node and a second contact node semi-rigidly and slideably mounted alongside said first contact node, wherein said first and second contact nodes are each configured to enable seating within a human adult rib-space and said second contact node is semi-rigidly mounted to enable semi-rigid spacing relative to said first contact node to generally match the distance separating a first human adult intercostal space and an immediately opposing second human adult intercostal space generally proximate a left sternal margin, respectively, and whereby following application of an engagement force to said first contact node against a first left intercostal space, said semi-rigidly mounted second contact node provides for automatic migration of said second contact node in response to said engagement force to match the position of a second differing and immediately opposing left intercostal space, thereby enabling nestled seating of said first and second contact nodes within said first and second differing and immediately opposing left intercostal spaces.

18. The vibratory attachment interface of claim 17, wherein at least said second contact node has a convex contact surface, such as to enable substantially snug, opposed seating within said second intercostal space.

19. The vibratory attachment interface of claim 17, wherein an engagement center of said first contact node and an engagement center of said second contact node are semi-rigidly spaced in the range of 2.50 cm and 3.75 cm apart prior to application of said engagement force to said interface, and are thereafter spaced in the range of 2.0 cm to 4.00 cm apart following application of said engagement force to said interface.

20. The vibratory attachment interface of claim 17, wherein an engagement center of said second contact node slides at least 1.0 cm relative to an engagement center of said first contact node following application of said engagement force to said interface.

21. The interface of claim 17, wherein said second contact node is semi-rigidly held in position by at least one of a spring and an elastic.

22. The vibratory attachment interface of claim 17, wherein said support member comprises a slit and a slideable member disposed within said slit, whereby said second contact node is attached to said slideable member.

23. A method for using the vibratory attachment interface as defined in claim 17, comprising the steps of:

a) positioning said vibratory attachment interface over a human adult anterior chest wall such that said first contact node generally overlies the anatomic left fourth intercostal space and said second contact node generally overlies the anatomic left third intercostal space, and then b) applying an engagement force to said first and second contact node against said fourth and third intercostal spaces, respectively, whereby following application of said engagement force said second contact node automatically slides in response to said engagement force from its initial semi-rigid position to achieve substantially flush, opposed seating within said third intercostal space.

24. A method for using the vibratory attachment interface as defined in claim 17, comprising the steps of:

a) positioning said vibratory attachment interface over a human adult anterior chest wall such that said first contact node generally overlies the anatomic left third intercostal space and said second contact node generally overlies the anatomic left fourth intercostal space, and then b) applying an engagement force to said first and second contact node against said third and fourth intercostal spaces, respectively, whereby following application of said engagement force said second contact node automatically slides in response to said engagement force from its initial semi-rigid position to achieve substantially flush, opposed seating within said fourth intercostal space.

25. A method of using the vibratory attachment interface as defined in claim 17, comprising the steps of:

a) emitting a vibration at a frequency between 1-1000 Hz and an oscillation amplitude between 0.1-10 mm through said attachment interface, and b) applying an engagement force to said first and second contact node of said attachment interface against an anatomic left third intercostal space and left fourth intercostal space of an individual, respectively, prior to completion of step 26 (a), whereby said vibration is thereby transmitted via said attachment interface to said left third and left fourth intercostal spaces, and whereby the spacing between said first and second contact node automatically adjusts following application of said engagement force in response to said force to provide optimized fitted seating within said left third and fourth intercostal spaces, and whereby said vibration is utilized for treatment of at least one of: heart attack, angina pectoris, coronary artery disease by induction of new coronary arterial growth, heart failure, cardiogenic shock, and combinations thereof.

26. The method of claim 25, whereby said vibration is timed to occur during a diastolic period of a cardiac cycle, and is turned off during a systolic period of the cardiac cycle.

27. A method for improving blood flow within the thoracic cavity, comprising the steps of:

a) providing a pair of contacts, each sized and shaped to enable seating within a human adult rib-space, b) applying an engagement force to said pair of contacts against an anatomic left third intercostal space and left fourth intercostal space, c) allowing the spacing between said pair of contacts to automatically change in response to said engagement force to provide an optimized, fitted position of said pair of contacts within said anatomic left third and fourth intercostal spaces, and d) applying a vibration to said pair of contacts at a frequency between 1-1000 cycles per second and an oscillation amplitude in the range of 1.0-10 mm against said anatomic left third and fourth intercostal spaces, whereby said optimized fitted position of said pair of contacts enables optimized transmission of said vibration from a chest wall of said thoracic cavity to the heart, such as to improve blood flow within the thoracic cavity.

28. The method of claim 27, wherein said vibration of said pair of contacts is initiated at any time following step 28 (a).

29. The method of claim 27, wherein said vibration is applied during a diastolic period of a cardiac cycle, and substantially turned off during a systolic period of the cardiac cycle.

30. The method of claim 27, wherein said improved blood flow relates to improved myocardial perfusion.

31. The method of claim 27, wherein said improved blood flow relates to improved cardiac performance, such as in treatment of at least one of: heart failure, cardiogenic shock or conversion from a hemodynamically unstable arrhythmia.

* * * * *